US010711376B2

(12) United States Patent
Hufenbach

(10) Patent No.: US 10,711,376 B2
(45) Date of Patent: Jul. 14, 2020

(54) CIRCULAR WEAVING MACHINE AND METHOD FOR PRODUCING A HOLLOW PROFILE-LIKE FABRIC

(71) Applicant: INNOTEC LIGHTWEIGHT ENGINEERING & POLYMER TECHNOLOGY GMBH, Goslar (DE)

(72) Inventor: Werner Hufenbach, Dresden (DE)

(73) Assignee: INNOTEC LIGHTWEIGHT ENGINEERING & POLYMER TECHNOLOGY GMBH, Goslar (DE)

( * ) Notice: Subject to any disclaimer, the term of this patent is extended or adjusted under 35 U.S.C. 154(b) by 68 days.

(21) Appl. No.: 16/098,469

(22) PCT Filed: May 3, 2017

(86) PCT No.: PCT/DE2017/100373
§ 371 (c)(1),
(2) Date: Nov. 2, 2018

(87) PCT Pub. No.: WO2017/190739
PCT Pub. Date: Nov. 9, 2017

(65) Prior Publication Data

US 2019/0153637 A1 May 23, 2019

(30) Foreign Application Priority Data

May 4, 2016 (DE) ..... 10 2016 108 359

(51) Int. Cl.
*D03D 37/00* (2006.01)
*D03D 13/00* (2006.01)

(52) U.S. Cl.
CPC ..... *D03D 37/00* (2013.01); *D03D 2700/16* (2013.01)

(58) Field of Classification Search
CPC ..... D03D 37/00; D03D 2700/168; D03D 25/005; D03D 2700/16; D03D 3/02; D03D 41/004; D03D 2700/03; D03D 3/00; D03D 41/00; D03D 47/267; D03D 13/00; D03D 5/02
See application file for complete search history.

(56) References Cited

U.S. PATENT DOCUMENTS 1,362,134 A * 12/1920 Paul ..... D03D 37/00 139/15
1,495,177 A * 5/1924 Hinsky ..... D03D 37/00 139/458

(Continued)

FOREIGN PATENT DOCUMENTS

CN 201857476 U 6/2011
EP 0080453 A2 6/1983

(Continued)

*Primary Examiner* — Robert H Muromoto, Jr.

(57) ABSTRACT

Circular weaving machine for weaving a weaving core (1), including at least one shuttle (5) which has a weft yarn bobbin (7) and can be moved along a circular continuous track around the weaving core (1), and warp coil devices (10), each of which having a warp yarn bobbin (11). The warp coil devices (10) are designed to be movable, the travel path of the warp coil devices (10) with the warp yarn bobbin (11) extending through a weaving plane (6) enclosed by the circular continuous track (2, 23).

20 Claims, 18 Drawing Sheets

(56) References Cited

U.S. PATENT DOCUMENTS 1,830,454 A * 11/1931 Wismer ..... D03D 37/00 139/457
1,947,924 A * 2/1934 Sery ..... D03D 3/00 87/29
1,947,976 A * 2/1934 Alexander ..... D03D 37/00 139/457
1,965,395 A * 7/1934 Shuttleworth ..... D03D 39/16 139/2
1,984,798 A * 12/1934 Howarth ..... D03D 37/00 139/459
1,990,064 A * 2/1935 Alexander ..... D03D 37/00 139/16
2,335,111 A * 11/1943 Davis ..... D03D 37/00 139/371
3,815,643 A * 6/1974 Haoya ..... D03C 13/00 139/15
3,875,973 A * 4/1975 Kallmeyer ..... D03D 37/00 139/16
4,355,666 A * 10/1982 Torii ..... D03D 51/40 139/457
4,424,836 A * 1/1984 Torii ..... D03D 37/00 139/110
4,432,397 A * 2/1984 Cacciapuoti ..... D03D 37/00 139/458
4,479,517 A * 10/1984 Plammer ..... D03D 37/00 139/436
4,616,681 A * 10/1986 Huemer ..... D03D 51/34 139/371
4,619,293 A * 10/1986 Huemer ..... D03D 49/62 139/458
4,776,371 A * 10/1988 Schonberger ..... D03D 37/00 139/458
4,821,778 A * 4/1989 Zacek ..... D03D 37/00 139/457
4,977,933 A * 12/1990 Brais ..... D03D 37/00 139/15
5,099,891 A * 3/1992 Hiramatsu ..... D03D 37/00 139/457
5,293,906 A * 3/1994 Amin ..... D03D 37/00 139/309
5,787,938 A * 8/1998 Starlinger Huemer ..... D03D 49/20 139/457
5,826,626 A * 10/1998 Huemer ..... D03D 51/34 139/371
7,926,517 B2 * 4/2011 Horimoto ..... D03D 3/02 138/123
8,082,761 B2 * 12/2011 Wang ..... D03D 25/005 66/1 R
9,657,416 B2 * 5/2017 Hehenberger ..... D03D 51/34
2009/0126823 A1 * 5/2009 Yengkhom ..... D03D 3/02 139/450
2011/0014403 A1 * 1/2011 Wang ..... D03D 25/005 428/34.1
2016/0160409 A1 * 6/2016 Hehenberger ..... D03D 51/34 139/459

FOREIGN PATENT DOCUMENTS

EP 0167829 A1 1/1986
EP 2829645 A1 1/2015
FR 2339009 A1 8/1977
GB 2036813 A 7/1980
KR 20010037753 A1 5/2001

* cited by examiner

M
9
2
10,11
14a
13
15
5,7
6,8
16
1a
3
12
17
6,12

CIRCULAR WEAVING MACHINE AND METHOD FOR PRODUCING A HOLLOW PROFILE-LIKE FABRIC

BACKGROUND OF THE INVENTION

1. Field of the Invention

The invention relates to a circular weaving machine for weaving a weaving core, comprising at least one shuttle which has a weft spool and can be moved along a circular continuous track around the weaving core, and warp coil devices, each of which having a warp yarn bobbin.

The invention also relates to a method for the manufacture of a hollow profile-like fabric with a circular weaving machine of the type mentioned.

2. Discussion of Background Information

The known circular weaving machines and weaving processes on circular weaving machines are generally used for the production of tubular textile fabrics for fire hoses, water hoses, sacks etc.

A circular weaving machine of this type is known from publication EP 0080453 A2. Several shuttle rollers roll on an upper and lower raceway along a circular continuous track, each with a weft yarn bobbin (weft bobbin), which guides the weft in a circular continuous track around the weaving core. The shuttles are driven by a motor-driven rotor with drive rollers. Warp coil devices are arranged concentrically around the running rings, each of which feed one warp yarn through several yarn guides from a warp yarn bobbin (warp bobbin) via a tensioning device and a shed guide between the upper and lower running rings to the weaving core. To form the fabric on the weaving core, the shuttles pass between the alternately fanned warp yarns, with the shuttles' rollers running over the warp yarns at the bottom. The fabric produced is continuously pulled off the weaving core to form an endless fabric tube.

The multiple deflections and rolling over of the warp yarns create a considerable load on the warp yarns, which leads to a high wear of the warp yarns.

Particularly sensitive yarns, such as carbon fibers, are unsuitable for processing on circular weaving machines because of this risk of damage. This largely prevents the use of the known circular weaving machines for the production of fiber preforms for fiber composite products.

The multiple deflections required of the warp yarns also prevent high yarn tension, whereby the load on the warp yarns by the shed guide also leads to uneven yarn tension in the fabric. In this respect, the fabric cannot be pressed firmly against the contour of the weaving core, which is quite practicable for the usual continuous removal of an endless fabric tube from the stationary weaving core. However, the known circular weaving machines are unsuitable for weaving a weaving core with a fixed fabric, especially for weaving a weaving core with a variable core contour. In this respect, the known circular weaving machines cannot be used to produce hollow-profile products such as rims, tubes and shafts with unequal diameters in their finished geometry.

The circular weaving machine known from publication FR 2339009 A1, the warp yarns are fed via warp yarn bobbins and yarn guide tubes with tilting bearings, whereby these cross the running grooves for the circulation of the shuttle. The running grooves are interrupted by slots along which the yarn guide tubes occupy their changing positions. This embodiment avoids warp yarns from rolling over and warp yarn shedding, which reduces yarn wear. However, the swivelling of the yarn guide tubes, in which the warp yarn rubs against the inner wall of the tube, again leads more than minor yarn wear. In addition, when the yarn guide tubes are pivoted in a circular arc, the yarn tension in the weaving point decreases significantly, which, in addition to a very loose fabric, can lead to an unclean weaving pattern with bevelled edges. The jarring circulation of the shuttles over the slots additionally leads to vibrations and yarn tension fluctuations.

The applicability of this known circular weaving machine is therefore just as disadvantageously limited.

The invention is based on the object of providing a circular weaving machine and a process for producing a hollow-profile fabric which extends the applicability of the known circular weaving machine and in particular enables greater variability of the fabric structures and patterns that can be produced and the contoured weaving of a weaving core with variable geometry.

SUMMARY OF THE INVENTION

In order to solve the problem, a circular weaving machine is envisaged in accordance with the invention, in which the warp coil devices are designed to be movable, whereby the travel track of the warp coil devices travels through a weaving plane enclosed by the circular continuous track with the warp yarn bobbin.

One or more shuttle(s) move with their weft yarn bobbins along a circular continuous track that may, for example be mechanically or electromagnetically formed, which determines the conveying or guiding line for concentric conveying or guiding of the shuttle around the weaving core.

The shuttle(s) may be actively moved along the path, whereby the path is formed as a guide track, or the shuttle(s) may be conveyed passively along the path, whereby the path comprises a conveyor track.

The weaving plane which can be used to pass through the warp coil devices or the warp yarn bobbins is essentially radially limited by the geometrically determined, circular continuous track for conveying or guiding the shuttle and is further determined by the course of the weft yarn in the shuttle.

In the case of a deflection-free course for the weft yarn in the shuttle rotating along the circular continuous track, the weaving plane describes a circular disc which is enclosed by the circular continuous track and in which the weft yarn runs.

The circular continuous track is preferably arranged radially (perpendicular to the weaving axis) relative to the weaving axis of the weaving core, which gives the circular loom an especially narrow design.

For certain applications of the weaving machine, however, it may be advantageous to arrange the circular continuous track quasi-radially (at an angle not equal to 90° to the weaving axis). Accordingly, the weaving plane thus formed can be oriented both perpendicular to the weaving axis and quasi-radial (at an angle not equal to 90° to the weaving axis).

In some cases, the weft yarn in the shuttle may be deflected within the circular continuous track. In this case, the weaving plane enclosed by the circular continuous track that is determined by the course of the weft yarn, deviates from a flat, circular-disc shape. The weaving plane is then deflected according to the weft deflection.

The warp coil devices with the warp yarn bobbins are preferably located in the immediate vicinity of the weaving plane, in particular sideward of the weaving plane, in order to be able to move the warp coil devices or the warp yarn bobbins repeatedly back and forth through the weaving plane in short distances and with little effort, whereas the passage of the shuttle is ensured by means of the turning position of the warp coil devices and/or of the warp yarn bobbins.

The warp yarns can be spread alternately in opposite directions by changing the position of the warp yarn bobbins so that warp yarn shedding occurs, whereby the warp yarns are undulated with the weft yarn passing through the warp yarn shedding, which is drawn off from the weft yarn bobbin of the shuttle carried along the path.

A wide variety of weaving patterns may be created depending on the sequence and the operating cycles in which the warp bobbins change position.

By means of the direct lateral mobility of the warp coil devices or the warp bobbins through the weaving plane enclosed by the path, it is possible for the warp yarns to cross the feed or guide track of the shuttle without making contact. The feed or guide track of the shuttle is free of transverse warp yarns and does not require any recesses for yarn guides. As a result of the uninterrupted, homogeneous conveyor or guide track, the shuttle can circulate very quickly and with a low vibration level, while maintaining high weft yarn tension.

The warp yarns are fed directly via a short path, and without deflection as far as possible, to the weaving point at which the warp yarns are woven (undulated) with the weft yarns on the surface of the weaving core, which considerably reduces the yarn abrasion of the warp yarns and enables high yarn tension.

The lateral spreading of the warp yarns can be influenced by variably positioning the warp yarn bobbins in relation to the weaving plane and can be further optimized in such a way that, by creating a through-path for the shuttle, the angle of the warp yarns to the weaving plane is as flat as possible (weaving angle), so that the yarn tension of the warp yarns remains largely constant when the warp yarn bobbins change position.

The geometric design of the circular weaving machine in accordance with the invention makes it possible in particular to provide a large diameter for the circular continuous track for conveying or guiding the shuttle in relation to the positioning track for the warp coil device or the warp bobbins, whereby a very small angle of the warp yarn guide in relation to the weaving plane (weaving angle) can be realized thereby ensuring a particularly pronounced homogeneity in yarn tension.

As a result, a tightly woven fabric of high weaving quality can be produced at a very high circulation speed under a high yarn tension for the weft yarns and warp yarns and without damage to the yarn.

Furthermore, the operation of the circular weaving machine in accordance with the invention is rendered more efficient.

Due to the feasibility of high weft and warp tension, the circular weaving machine in accordance with the invention is particularly suitable for weaving cores with variable cross-sectional geometry in axial extension, since the tightly woven yarns can rest true to contour against a changing weaving core contour. For weaving a contoured weaving core with a fixed, stationary fabric, the weaving core is moved in the direction of its axis of rotation (weaving core axis) or along the congruent weaving axis of the circular weaving machine in order to be able to move the complete contour of the weaving core. The weaving point at which the warp yarns are woven with the weft yarns on the surface of the weaving core moves along the longitudinal axis of the weaving core.

Due to the careful guidance of the weft yarns and warp yarns, a wide variety of yarn, ribbon or fiber materials in different fiber thicknesses can be used as weft yarns or warp yarns, such as sensitive carbon fibers, but also wide flat ribbons or other textile strands. The warp and weft bobbins used can also be equipped with different yarn, tape or fiber materials in different fiber thicknesses.

Last but not least, the circular weaving machine in accordance with the invention is suitable for the production of hollow-profile fabric preforms from fibers for further processing into fiber composite products, e.g. for the production of woven preforms for wheel rims made of fiber composite material.

The compact, concentric design of the circular weaving machine offers generous access to the weaving plane and the weaving core on both sides, so that the weaving cores can be inserted or removed from both sides into the circular weaving machine by mechanical means, such as handling robots. The free space provided by the concentric design also makes it possible to use weaving cores with particularly large diameters.

In an advantageous embodiment of the weaving machine in accordance with the invention, several circular continuous tracks (conveying and/or guiding tracks) can be used, along each of which one or more shuttles are conveyed or guided and which each comprise a weaving plane through which the warp yarn bobbins pass alternately and iteratively. Combined circular continuous tracks enable parallel operation of several shuttles with different directions and cycles of rotation and different yarn, tape or fiber materials, allowing a multitude of different weft yarns to be processed simultaneously and creating an even greater variety of possible weaving patterns and fabric properties.

The circular continuous tracks for conveying or guiding the shuttles (conveyor or guide tracks) can preferably be arranged parallel to each other, but also aligned in different directions. In particular, both radially oriented weaving planes and quasi-radially oriented weaving planes can be combined with respect to the weaving axis.

Additional weaving planes with and without distortions can be combined if a combination of circular continuous tracks with integrated deflections is provided.

Based on an additional advantageous embodiment of the circular weaving machine, the circular continuous track for guiding the shuttle(s) is formed by an annular guide track (guide track) in or on which at least one shuttle is guided.

In this case, the shuttle or shuttles run by means of a rolling or sliding element in or on an annular guide track (guide track) which defines the circular continuous track along which the shuttle(s) circulate, the warp coil devices or warp yarn bobbins move through the weaving plane before or after the shuttle has passed through the weaving plane which is radially enclosed by the interior of the annular guide track and formed by the course of the weft yarns within the annular guide track.

In this embodiment, the warp yarns are alternately split-off by the change of position of the warp coil devices or the warp yarn bobbins on both sides of the weaving plane, without influencing the path of the guide track or the passage of the shuttles in any way.

The warp yarn bobbins can preferably cross the weaving plane near the radial inner boundary of the annular guide track which limits the weaving plane in it radial extension.

The guide track can, for example, be designed as an internal rotor track in which the shuttle(s) circulate within the circular continuous track radially bounded by the guide track and thus within the weaving plane. The guide track can also be designed as an external rotor track in which the shuttle(s) rotate outside the circular continuous track radially bounded by the guide track and thus outside the weaving plane. An embodiment in which the shuttle(s) are integrated within the guide track and thus do not circulate in the weaving plane is also conceivable.

In all cases, the guide tracks offer a continuous, uninterrupted runway, which enables the shuttles to circulate without vibration with uniformly high yarn tension, thus achieving homogeneous weaving operation at a high weaving speed.

If the guide track is designed as an external slide track in which the rotating shuttle moves outside the circular continuous track and the weaving plane, the weaving plane is passed through only by the weft yarn of the weft yarn bobbin, so that the warp coil devices including the warp yarn bobbins can be placed closer to the weaving plane. This makes the circular weaving machine even more compact. On the other hand, the maximum weaving angle for the warp yarns to the weaving plane becomes even smaller, thus further improving the homogeneity of yarn tension. Finally, the transfer paths of the warp yarn bobbins are also made even shorter, resulting in higher weaving speeds.

The guide track has the advantage of comprising multiple sub-tracks.

In this case, a shuttle is guided along its circular continuous track (guide track) by a multi-part guide track, consisting of two or more sub-tracks thereby improving guidance of the shuttle and thus permitting the shuttle to travel largely free of vibration and noise. The spaces between the spaced tracks allow, for example, the weft yarn to pass through an external-rotor guide track or, for example, access for the shuttle drive.

Based on one advantageous embodiment, the shuttle(s) is/are each driven by a direct drive and thus individually. The shuttles rotating in or on the guide track (guide track) can be individually controlled to form specially desired weaving patterns and thus run independently of one another and temporarily at different speeds and directions or may be stopped temporarily.

Alternatively, the shuttle, preferably several shuttles, can be driven individually or together by means of a rotatably mounted, driven carrier. With this type of drive, the shuttles running along the guide track (guide track) can be driven by various carrier elements of the carrier. This allows several shuttles to circulate simultaneously and at a constant distance from each other, which minimizes the design effort and space required for the shuttle drive compared to the direct drive. The carrier can be designed as a ring-shaped carrier ring.

Based on an alternative advantageous embodiment of the circular weaving machine in accordance with the invention, the circular continuous track for guiding the shuttle(s) is formed by an annular rotor (conveyor path), preferably mounted rotatably on the machine frame, to which at least one shuttle is attached and can thus be conveyed with the rotor.

In this embodiment, one or more shuttles attached to the annular rotor (rotor ring) are conveyed along a common circular continuous track determined by the rotor ring. Unlike the embodiment with a guide track, the shuttles are not actively guided along the path (guide track) but are conveyed passively in fixed connection with the path (conveyor track).

The warp coil devices, or the warp yarn bobbins, pass through the interior of the rotor ring, which radially limits the weaving plane, whereby the warp yarns are alternately split-off by the iterating change in position of the warp yarn bobbins on both sides of the weaving plane, which is determined by the course of the weft yarns within the rotor ring without influencing the rotation of the rotor ring or the shooter in any way.

The warp coil devices or the warp yarn bobbins can preferably cross the weaving plane near the radially inner boundary of the rotor ring which radially limits the weaving plane.

The rotor ring functions on the one hand as a guide and as a driving mechanism on the other so as to guide and drive of all mounted shuttles. No separate guide tracks and drives are required resulting in less design effort.

The rotor ring can be driven centrally or decentrally by means of a motor affixed to the frame.

Particularly homogeneous, vibration-free weaving operation is achieved at a high rotation speed due to the circumstance that the shuttles rotate without any rolling or sliding resistance.

Particularly large weft bobbins can be used in light of the stable attachment of the shuttles to the rotor ring.

The shuttle or shuttles can be arranged radially inside the rotor ring and thus circulate within the weaving plane bounded by the rotor ring. In this case, the warp coil devices or the warp bobbins can be positioned sideways of the weaving plane, taking into account the circulation space of the shuttle rotating in the weaving plane.

The shuttle or shuttles can also be arranged radially on the outside of the rotor ring and thus circulate outside the weaving plane bounded by the rotor ring.

In this embodiment of the shuttles, for example, the weft yarns can be fed inwards through a guide eye in each rotor ring and into the weaving plane.

If the shuttle is arranged radially on the outer side of the rotor ring, after which it moves outside the weaving plane bounded by the circular continuous track, the weaving plane, analogous to the design with the external-rotor guide track, is only passed through by the weft yarn of the weft yarn bobbin itself, so that the warp coil devices with the warp yarn bobbins can be placed directly next to the weaving plane without having to take the rotational space of the shuttle into account. This offers the same advantages as the version with the external-rotor guide track referred to here.

A lateral or integral arrangement of the shuttle(s) on or in the rotor ring is also conceivable, whereby the shuttle(s) likewise do not circulate in the weaving plane.

In a preferred embodiment of the arrangement of the weft bobbin on the shuttle, the axis of rotation of the weft bobbin is arranged around the weaving axis in the direction of rotation of the shuttle. In other words, the axis of rotation of the weft bobbin is tangential to the rotation of the shuttle. The circulation of the shuttle is so space-efficient that the circular weaving machine can be made all the more compact.

Alternatively, it may be advantageous to arrange the axis of rotation of the weft bobbin perpendicular to the weaving axis, whereby the overlap of the weft bobbin with the warp coil devices or the warp bobbins is smaller when the weft bobbin passes through and more space and time remains for the position change of the warp coil devices and/or warp bobbins.

Depending on the weaving material used and the desired weaving result, it may be advantageous for the axis of rotation of the warp bobbin to be arranged substantially parallel to the weaving axis (and thus substantially perpendicular to the weaving plane) or substantially tangential to the weaving axis (and thus substantially parallel to the weaving plane). In these embodiments, the warp yarn is drawn off from the warp bobbin tangentially and thus without any deflection, which is an advantage when using very brittle fibers, such as high-modulus carbon fibers.

One advantageous embodiment of the circular weaving machine is designed such that the travel path of the warp coil device with the warp bobbin is designed in the form of a circular arc with a constant radius through the weaving plane.

Such a movement of the warp coil device with the warp bobbin through the weaving plane keeps the length of the warp yarn from the warp yarn bobbin to the weaving point constant over the entire travel distance of the warp yarn bobbin, so that any fluctuations in yarn tension during delivery or acceptance of the warp yarn bobbins may be avoided when spreading the warp yarns. This allows a particularly homogeneous, firm fabric to be created.

One particularly advantageous embodiment of the circular weaving machine is designed such that the warp coil device with the warp bobbin can be moved along a travel path to the side of the weaving plane.

Based on this embodiment of the circular weaving machine, the warp coil device with the warp bobbin can be moved both through the weaving plane and beside the weaving plane, preferably parallel to the weaving plane.

One or more warp coil devices with the warp bobbin(s) can be guided around the circumference of the circular weaving machine cyclically or continuously, iterating or alternating, in sections or completely and at variable distances from one another and from the weaving axis.

This allows any variable course of the warp yarns in relation to the weaving axis to be generated, which considerably expands the possible variations in fabric structures and fabric patterns that can be achieved with the circular weaving machine.

A structurally advantageous design provides that the warp coil device can be moved with the warp bobbin by means of a positioning device and can be positioned in defined alternating positions. The positioning device moves the warp coil device with the warp yarn bobbin along a predetermined travel path and into differently adjustable alternating positions on both sides of the weaving plane in order to alternately change sides and divide the warp yarn.

The positioning device can be fixed to the frame of the machine housing of the circular weaving machine, e.g. on the frame for the conveyor or guide track, or it can also be mounted movably on the latter. The positioning device has a means for moving and positioning the warp coil device or the warp yarn bobbin.

In a practical embodiment of the positioning device, it has at least one movable bobbin gripper and one stationary bobbin gripper, wherein the movable bobbin gripper aids in the alternating transfer of the warp-yarn bobbin from one change position to another change position and the stationary bobbin gripper temporarily fixes or locks the warp yarn bobbin in one of the change positions.

The movable bobbin gripper can be moved, for example, by means of a guided gear rod (guide rod), which is driven by an actuator. This allows a linear, quick change of position of the warp bobbin on both sides of the weaving plane.

In one particularly advantageous embodiment, the positioning device alternatively has at least two movable bobbin grippers.

This means that both the warp bobbin can be transferred from one change position and the warp bobbin can be transferred to the other change position simultaneously and halfway along the travel path and vice versa. The movable bobbin grippers move towards each other for delivery/acceptance of the warp yarn bobbin, so that the distance to be covered and thus the travel time for each movable bobbin gripper is reduced by half. As a result, the time needed for the circulation path of the shuttle is shorter via the bobbin grabber passing through the warp yarn bobbin so that the rotational speed of the shuttle or the number of circulating shuttles can be increased.

In combination and interaction of two movable bobbin grippers with a stationary bobbin gripper, the warp yarn bobbin can be delivered or accepted in sections, such as, for example, delivery or acceptance into an intermediate position between two weaving planes in a design with two circular continuous tracks (conveyor and/or guide tracks) arranged next to each other.

The design of the positioning device for positioning a warp coil device with the warp yarn bobbin can be expanded by several movable bobbin grippers and several stationary bobbin grippers.

In a particularly advantageous embodiment of the circular weaving machine, the positioning device has a handling robot or is arranged on a handling robot.

If the positioning device has a handling robot, all degrees of freedom can be used for guiding and positioning the bobbin grippers and thus the warp coil device with the warp yarn bobbin.

If the positioning device is arranged on a handling robot, linear movement of the movable bobbin grippers of the positioning device through the weaving plane can be combined with freely selectable travel or position change for the positioning device lateral in relation to the weaving plane, which results in considerable travel path combinations for the warp coil device with the warp yarn bobbin.

In another advantageous embodiment of the circular weaving machine, the positioning device is arranged on a warp bobbin ring mounted to rotate about the weaving axis. This allows the positioning device to rotate laterally in relation to the weaving plane along a defined radius around the weaving axis using simple methods.

Several positioning devices can be placed on the warp bobbin ring and moved simultaneously at a fixed distance to each other and to the weaving axis.

The movement of the warp bobbin ring, and thus of the warp coil devices with the warp yarn bobbins, can be adjusted continuously or discontinuously, clockwise or counter-clockwise by means of a drive.

This design makes it possible, for example, to combine the linear movement of the mobile bobbin grippers of several positioning devices through the weaving plane with the rotary movement of the positioning devices laterally in relation to the weaving plane, which also results in a large number of guide track combinations for the warp coil devices with the warp yarn bobbins.

Based on an additional design, in the alternating position, the radial distance of the outer contour of the warp coil device with the warp yarn spool and/or the radial distance of the outer contour of the positioning device from the weaving axis, may be smaller than the radial distance of the inner contour of the shuttle from the weaving axis.

In this arrangement of the machine elements relative to one another whereby the shuttle that revolves around the weft bobbin in the weaving plane is separated from the weaving axis by a larger radius than the warp coil device from the warp yarn bobbin and/or the positioning device, the size and the distance between the shuttle and the warp coil device with the warp yarn bobbin and/or the positioning device may be selected without influencing each other, without hindering the necessary rotation space of the weft yarn bobbin.

In this manner, the size of the weft bobbin, for example, can be selected largely independently of the space required by the warp yarn bobbin or positioning device and vice versa. Weft bobbins with an even larger diameter can be used without having to increase the lateral distance between the warp coil device and the warp bobbin or the lateral distance between the positioning device and the weaving plane. Uninterrupted weaving time can be increased with large weft bobbins and warp yarn bobbins.

Conversely, the machine elements are arranged in a particularly compact and space-saving manner, since the warp coil device or the warp bobbins can be positioned directly next to the weaving plane with the weft yarn passing through.

The resulting shorter transfer path for the warp coil device or the warp yarn bobbin and the associated shorter transfer time for the bobbin gripper also allows weaving speed to be increased.

Furthermore, this results in a particularly small weaving angle of the warp yarns to the weaving plane, which ensures almost constant yarn tension when changing the position of the warp yarn bobbins and also creates a homogeneously taut fabric.

Alternatively, the radial distance of the outer contour of the shuttle from the weaving axis may be smaller than the radial distance between the inner contour of the warp coil devices and the warp yarn bobbin and/or the radial distance of the inner contour of the positioning device from the weaving axis.

This results in another advantageous variant for a space-saving and compact arrangement of the machine elements in relation to each other.

For example, the shuttle rotating in the weaving plane with the weft bobbin can be radially spaced from the circular continuous track along which the shuttle is guided or conveyed by means of an extended support, so that the warp coil device with the warp bobbin or the positioning device can operate in a radial region of the weaving plane between the circular continuous track and the shuttle.

The warp coil device with the warp bobbin or the positioning device can thus be positioned close to the weaving plane in such a way that just enough space is left for the throughfeed of the shuttle holder rotating in the weaving plane and, due to the shed spread of the warp yarns, just enough space is left for the throughfeed of the shuttle.

In this arrangement, the shuttle is exposed to lower centrifugal force in particular. This means that the circular weaving machine can be operated at a higher shuttle speed and thus at a higher weaving speed with less vibration at the same time. In addition, the machine frame can be made lighter due to the reduced centrifugal force. The reduced centrifugal force also prevents the fiber material from being displaced.

In accordance with an additional advantageous embodiment of the circular weaving machine, the weft bobbin can be arranged on any shuttle by means of a handling robot. This enables the automated exchange of the weft bobbins and in particular an arbitrary positioning of the weft bobbins with the weft yarns on different shuttles when producing a fabric.

This makes the operation of the circular weaving machine even more efficient and further increases the variability of the weaving patterns and fabric properties that can be produced.

Preferably, the weaving core is axially movable and/or rotatable.

In the case of the axially movable design, the weaving core can be moved along its weaving core axis or the weaving axis of the circular weaving machine in relation to the weaving point, so that a textile fabric that remains on the weaving core can be created. This means that the textile fabric is applied to the weaving core in a stationary manner—without being conveyed by the weaving core, as is the case with conventional hose removal using state-of-the-art technology. After weaving, the finished fabric can be removed from the weaving core or removed from the circular weaving machine with the weaving core. This makes it possible to produce individual hollow-profile-type woven products designed according to the weaving core used in each case.

In the case of the combined embodiment, the weaving core can also be rotated during axial movement in order to create corresponding angular positions of the warp yarns (and weft yarns) in relation to the weaving axis on the weaving core, which is particularly favourable for the load-bearing capacity of fabrics or components subject to torsional stress.

According to an additional embodiment, it is envisaged that the weaving core will have a variable cross-section geometry. By achieving high and uniform yarn tension in the fabric, individual hollow-profile-like woven products can be produced with a fabric that lies tightly against the cross-sectional contour of the woven core. Finally, weaving cores can be used which exactly map the desired geometry of the weaving product.

If the weaving core is multi-part, the finished fabric, in particular a fabric with a variable cross-sectional contour, can be removed more easily from the weaving core.

A method for the production of a hollow-profile fabric with a circular weaving machine according to one of the device requirements is also provided in accordance with the invention for solving the defined task thus converting the advantages of the device described above into corresponding procedural advantages.

Based on an advantageous embodiment of the method, the weaving core is continuously or discontinuously moved axially in the direction of its weaving core axis or along the congruent weaving axis of the circular weaving machine and/or rotated around its weaving core axis or around the weaving axis during the weaving process. The axial and rotational movement of the weaving core referred to also includes the corresponding opposing backward movement.

Based on the foregoing, the positioning of the weaving point in relation to the weaving core is extensively variable, so that the density, the layers of the fabric and the orientation of the weaving yarns along the weaving core can be varied and certain fabrics with different fabric densities, fabric layers and fabric structures can be produced.

Based on a preferred embodiment of the method, the weaving core can be inserted and removed from both sides of the circular weaving machine. As a result of the consistently concentric design of the circular weaving machine, this area can be used on both sides of the circular weaving machine for the continuous or discontinuous feeding and discharge of weaving cores to and from the circular weaving machine. This option for movement provides beneficial conditions for automating the changing process for the weaving cores.

This means that the weaving cores to be moved in the circular weaving machine can be changed either in an automatic inline or return line process.

According to one embodiment of the method, it may be technologically advantageous to use the web core as the form and consolidation core.

For this purpose, the hollow-profile-like fabric produced is left on the weaving core for further processing and, after removal of the weaving core from the circular weaving machine, is immediately subjected to further processing together with the weaving core.

Further processing can include impregnation of the produced fabric with resin and further consolidation of the impregnated fabric, whereby the weaving core continues to serve as a form and consolidation core. Only after this further treatment is the finished, is the cured hollow profile-like fabric product demoulded from the weaving core.

Alternatively, the fabric produced can be brought into at least an inherently stable state before it is removed from the weaving core and further processed as an inherently stable, hollow-profile fabric preform into a hollow-profile fabric product. Inherent stability of the fabric preform can be achieved, for example, by adding and melting down a binder that bonds the woven yarns together.

These and other features resulting from the patent claims, the description of the representative embodiments and the drawings may be realized individually or in combination as advantageous embodiments of the invention for which protection is sought here.

BRIEF DESCRIPTION OF THE DRAWINGS

The device in accordance with the invention is explained in detail below by means of representative embodiments. The associated drawings in schematic representation illustrate the following.

DETAILED DESCRIPTION OF EMBODIMENTS OF THE INVENTION

Figure 1:
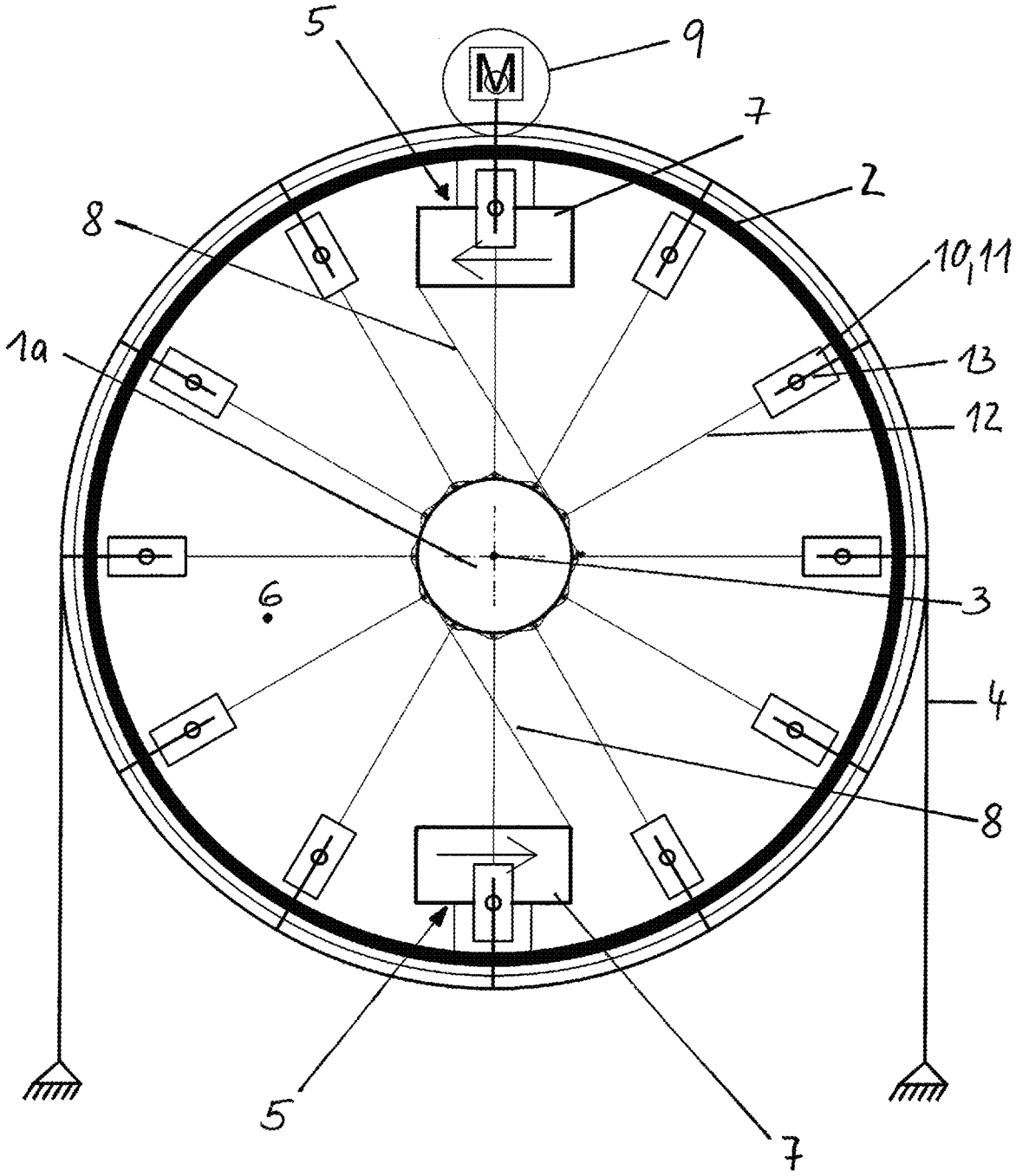
FIG. 1 A front view of a circular weaving machine in accordance with the invention with a rotor ring with two shuttles.

The circular weaving machine according to FIG. 1 has a centrically arranged weaving core 1*a* with a cylindrical cross-section and an annular rotor (rotor ring) 2. The weaving core 1*a* is rotatable about a weaving axis 3 and can be moved along this weaving axis 3 on a hollow cylindrical machine housing 4 of the circular weaving machine. The rotor ring 2 is also mounted rotatably on the machine housing 4 and rotates concentrically around the weaving core 1*a*.

Two shuttles 5 are mounted on the rotor ring 2 which are offset by 180° and are thus arranged opposite one another, and are consequently conveyed along the continuous circular track (conveyor track) 2 around the weaving core 1*a* formed by the rotor ring 2 at a constant distance from one another, the conveying line of the shuttles 5 being determined by the shape of the rotor ring (conveyor track) 2. In this representative embodiment, the interior of the rotor ring 2 limits a usable weaving plane 6 of the circular weaving machine to a radial extent.

The shuttles 5 each have a weft yarn bobbin (weft bobbin) 7, the weft yarn 8 of which is guided under a specific yarn tension linear to the weaving point on the weaving core 1*a* for moving the weaving core 1*a*. The shape of weaving plane 6 in the interior of the rotor ring 2 is—as can be seen in FIG. 2*a, b, c* in particular—determined by the course of weft yarn 8—essentially circular-disc-shaped, whereby in this design the shuttles 5 project into the interior of the rotor ring 2 and consequently circulate within weaving plane 6.

Figures 2A, 2B, 2C:
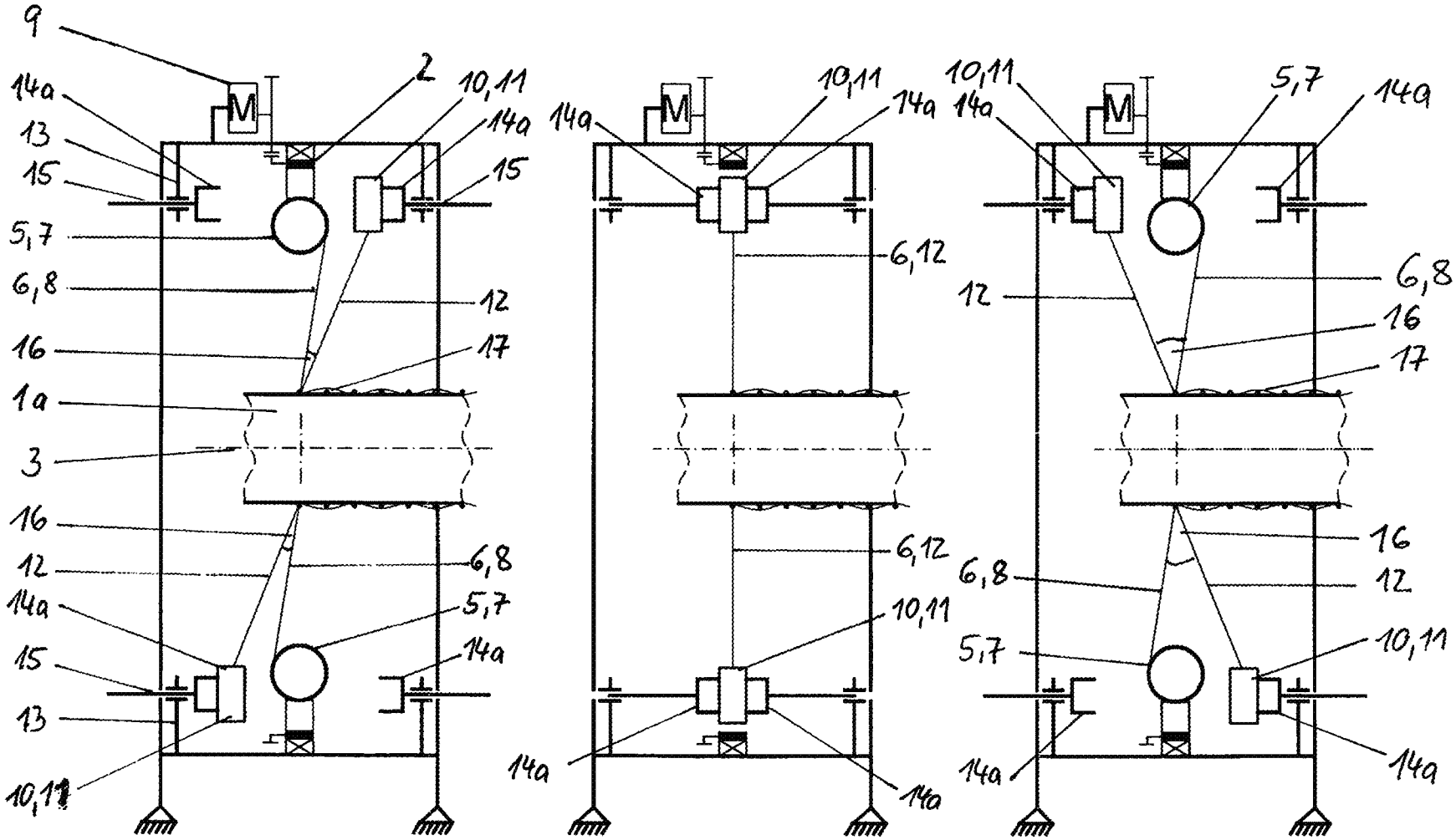
FIG. 2*a, b, c* A side view of the circular weaving machine according to FIG. 1 in three working phases of weaving a weaving core.

As can be seen from FIGS. 1 and 2*a, b, c*, the rotor ring 2 is driven by a motor 9 via, for example, a toothed wheel gear. In the representative embodiment, the pivot bearing of the rotor ring 2 is mounted by means of a rolling bearing comprising the rotor ring 2.

Twelve warp coil devices 10 are arranged concentrically around the weaving core 1*a* and at the same distance from one another, each with a warp spool 11, the warp yarn 12 of which is guided linearly to the weaving point on the weaving core 1*a* under a specific yarn tension for moving the weaving core 1*a*.

The warp coil devices 10 can be moved essentially axially, primarily parallel to the weaving axis 3 by means of a positioning device 13 attached to each machine housing 4 and can be positioned in two changeable positions next to weaving plane 6 (see FIG. 1, 2*a, b, c*).

Each positioning device 13 for moving and positioning the warp coil device 10 or the warp spool 11 provides two mobile spool grippers 14*a*, which are arranged on both sides of the rotor ring 2 distributed over the circumference of the circular weaving machine in accordance with FIG. 2.

For the sake of clarity, only two positioning devices 13 are shown in FIG. 2*a, b, c*, namely the twelve positioning devices arranged uniformly around the circumference of the hollow cylindrical machine housing 4 of the circular weaving machine in the 6 o'clock and 12 o'clock positions.

The two bobbin grippers 14*a* of each of the positioning 13 are mounted on the machine housing 4 axially movable by means of a guide rod 15 and can be individually controlled.

For purposes of the iterating change of warp yarns 12, the warp coil devices 10 and warp yarn 11 are guided through the weaving plane 6 parallel to weaving axis 3 by means of bobbin grippers 14*a* and alternately positioned in alternating positions on both sides of weaving plane 6.

The warp yarns 12 of the warp bobbins 11 guide at an alternating variable angle 16 with respect to the weaving plane 6 (weaving angle) to the weaving point on the weaving core 1*a* whereas the weft yarns 8 run essentially perpendicular to the weaving axis 3 (see FIG. 2*a, b, c*).

By the alternately formed spreading of the warp yarns 12 to each other and the two shuttle 5 rotating in the direction of rotation of the rotor ring 2, the warp yarns 12 for weaving the weaving core 1*a* are woven with the weft yarns 8 to produce a hollow profile-like fabric 17.

The axis of rotation of the weft bobbins 7 carried by the shuttle 5 is in the circumferential direction of the shuttle 5 and the axis of rotation of the warp bobbins 11 is arranged essentially parallel to the weaving plane 6 and perpendicular to the weaving axis 3.

Based on this arrangement and alignment of bobbins 7, 11 to the weaving plane 6 or weaving axis 3, the weft yarns 8 and warp yarns 12 are fed into the weaving core 1*a* with as few or no deflections as far as possible.

FIGS. 2*a, b, c* show snapshots of three phases of the changing positioning process of the warp coil devices 10 and the warp yarn 11 in the circular weaving machine during rotation of the shuttle 5 by 180°.

In FIG. 2*a*, the two shuttles 5 are in the 6 o'clock and 12 o'clock positions of the circular weaving machine. In this position, the respective warp coil device 10 with the warp bobbin 11 is located in the image plane to the right of the rotor ring 2 or to the left of the rotor ring 2, so that the space for the passage of the shuttle 5 in the direction of rotation of the rotor ring 2 about the weaving axis 3 is cleared by the warp threads 12 spread off the weaving plane 6, thus forming a shed.

After the shuttles 5 pass through the 6 o'clock or 12 o'clock position, the bobbin grippers 14*a* of the positioning device 13 move towards each other in accordance with FIG. 2*b* and meet directly in the weaving plane 6 to transfer the warp coil devices 10 or the warp bobbins 11. This means that each bobbin gripper 14*a* only has to cover about half of the total distance between the changing positions of the warp coil devices 10 or of the warp yarn 11, which means that the position change can take place more quickly.

In the working phase according to FIG. 2*c*, the warp coil device 10 or warp yarn bobbin 11, previously positioned in the image plane to the right of the rotor ring 2, is located on the left side of the rotor ring 2; the warp coil device 10 or warp yarn bobbin 11, previously positioned in the image plane to the left of the rotor ring 2, is located on the right side of the rotor ring. As a result of the now-exchanged position of the warp coil device 10 or warp yarn bobbin 11, the warp yarn 12 is now spread in opposite directions from the weaving plane 6 and in turn creates the space (shed) for a new pass-through of the shuttle 5, whereby the shuttle 5, previously located at the 6 o'clock position, passes through the 12 o'clock position and vice versa. The warp coil device 10 or warp bobbin 11 can also be changed after the shuttles 5 have passed through several times.

The warp yarns 12 are alternately spread in opposite directions in the prescribed or another alternating mode of the warp coil devices 10 or warp yarn bobbins 11, whereby as a result the warp yarns 12 are undulating with the weft yarns 8 of the shuttle 5 carried along on the track of rotor ring 2 to produce a fabric 17 with the desired weaving pattern.

By means of the controllable drive motor 9 of the rotor ring 2 and the individual drive and the control of the bobbin gripper 14, the weaving pattern can also be changed during the weaving process.

A high weft tension of weft thread 8 can be built up by the shuttle 5 fixed to the rotating rotor ring 2 and the weft thread 8 running in a straight line from the weft thread bobbin 7 on the weaving core 1*a*, whereby a very strong fabric 17 can be produced on the weaving core 1*a*.

The warp coil devices 10 with the warp yarn bobbins 11 are arranged in direct lateral proximity to the interior of the rotor ring 2 and thus near the weaving plane 6, so that the transfer of the warp coil devices 10 or warp bobbins 11 can take place on short paths and also the angular change of the weaving angle 16 of the warp yarns 12 to the weaving plane 6 during the position change of the warp coil devices 10 or the warp yarn bobbins 11 is small.

During the weaving process, for example, the weaving core 1*a* can be fixed in a stationary position depending on the desired weaving result, whereby the fabric 17 is continuously pulled off the weaving core 1*a* in the axial direction along the weaving axis 3. Alternatively, the weaving core 1*a* can be axially movable along the weaving axis 3, whereby the fabric 17 is deposited on the weaving core 1*a* in a fixed/stationary manner. Depending on the desired weaving result, the axial movement of the weaving core 1*a* can be quasi-stationary, discontinuous or continuous. It is also possible to move the weaving core 1*a* forward and backward to produce several layers of fabric 17.

During its axial movement, the weaving core 1*a* can also be rotated about the weaving axis 3 to produce a changed angular position of the warp yarns 12 and weft yarns 8 of e.g. +/−60° to the weaving axis 3 on the weaving core 1*a*.

After weaving the weaving core 1*a* through a fabric 17 remaining stationary on the weaving core 1*a*, the weaving core 1*a* can be removed sideways from the circular weaving machine and the circular weaving machine can be equipped with a further moveable weaving core 1.

Figure 3:
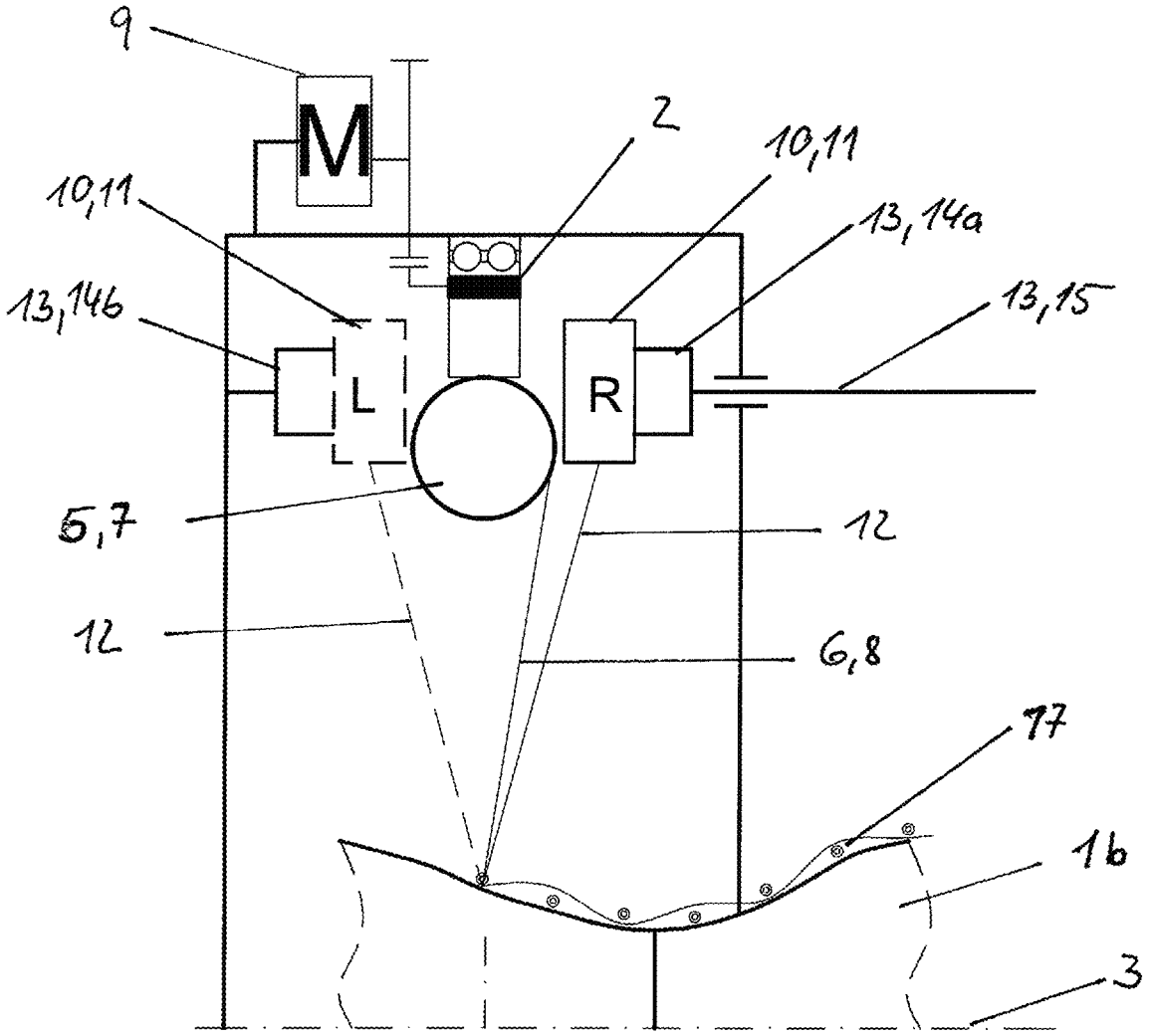
FIG. 3 A semi-profile of the circular weaving machine according to FIG. 1 with an alternative positioning device when weaving a contoured, two-part weaving core with a variable cross-section.

FIG. 3 shows a semi-profile cut-out of the circular weaving machine according to FIG. 1, 2*a, b, c*, which shows the weaving of an unevenly contoured weaving core 1*b* with variable cross-section in the manner of a double paraboloid (diaboloid). The unevenly contoured weaving core 1*b* is moved axially along the weaving axis 3, whereby the fabric 17 is deposited in a fixed/stationary manner along the weaving core 1*b*.

Only the differences compared to the circular weaving machine according to FIG. 1, 2*a, b, c* are described below.

The taut yarn guidance of weft yarn 8 and warp yarn 12 with largely deflection-free yarn guidance and with essentially uniform yarn tension makes it possible to produce a fabric 17 that is tight against the unevenly contoured weaving core 1*b* and follows the contour of the weaving core 1*b* true to contour.

The unevenly contoured weaving core 1*b* is designed in two parts to facilitate demoulding of the correspondingly shaped fabric 17. The transverse separation of the weaving core 1*b*, as shown in the representative embodiment, makes it possible to easily separate the weaving core 1*b* from the double-parabolic fabric 17 on both sides.

Of the twelve positioning devices 13 for moving and positioning the warp coil devices 10 and the warp bobbins 11, only one is shown in FIG. 3—analogous to FIGS. 2*a, b, c*—for the sake of overview, namely the positioning device 13 arranged in the 12 o'clock position of the circular weaving machine.

In contrast to the embodiment according to FIG. 2*a, b, c*, the positioning devices 13 according to FIG. 3 each provide only one axially movable bobbin gripper 14*a* (here in the image plane on the right), whereby the associated stationary bobbin gripper 14*b* (in the image plane on the left), which is arranged opposite the weaving plane 6, is fixed to the machine housing 4.

For alternating positioning, the warp coil device 10 or the warp yarn bobbin 11 (right position of the warp yarn bobbin marked with R) located in the image plane right of the weaving plane 6 is guided through the weaving plane 6 by means of the movable bobbin gripper 14*a* and transferred to the corresponding stationary bobbin gripper 14*b* left of the weaving plane 6, which holds the warp coil device 10 or the warp yarn bobbin 11 during a changing cycle (left position of the warp yarn bobbin 11 marked with L). After the shuttle 5 has passed through with the weft bobbin 7, the movable bobbin gripper 14*a* removes the warp coil device 10 or the warp yarn bobbin 11 from the stationary bobbin gripper 14*b* and returns it to the initial alternating position, from where it is transferred again to the stationary bobbin gripper 14*b* after the additional shuttle 5 has passed through. The movable bobbin gripper 14*a* covers the entire distance between the alternating positions on both sides of the warp coil device 10 or the warp yarn bobbin 11 by means of the correspondingly extended guide linkage 15. The process is repeated in a certain alternating mode related to the run of the shuttle(s) 5.

In this embodiment, only half of all bobbin grippers 14 are movable in contrast to the embodiment according to FIG. 2*a, b, c*, as a result of which the design effort for the axial movement and positioning of the warp bobbin device 10 and the warp bobbin 11 is advantageously reduced.

Figure 4:
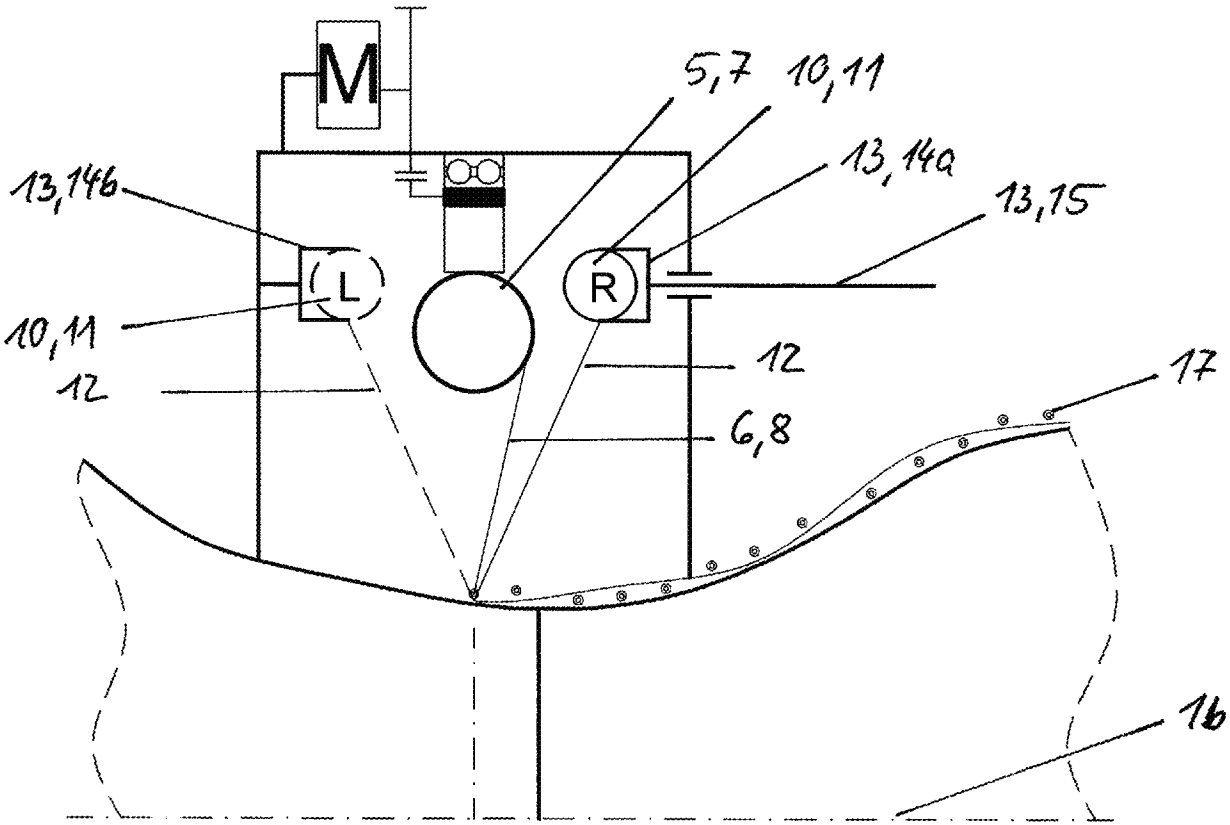
FIG. 4 A semi-profile of the circular weaving machine according to FIG. 1 with a warp coil device and the axis of rotation of the warp bobbin arranged tangentially to the weaving axis.

FIG. 4 shows a semi-profile section of the circular weaving machine according to FIG. 1, 2*a, b, c* with a positioning device 13 according to FIG. 3. In contrast to FIG. 3, the circular weaving machine has a different arrangement of the warp bobbins 11 and a particularly large, unevenly contoured weaving core 1*b*.

The circular weaving machine according to FIG. 4 illustrates a different operating cycle for the positioning device 13 that generates a clearly different weaving pattern for the fabric 17 on the weaving core 1*b*.

Only these differences in the circular weaving machine and the weaving process will be discussed below.

As regards the arrangement of the warp bobbins 11 in comparison to the circular weaving machine according to FIG. 3, the axis of rotation of the warp bobbin 11 according to FIG. 4 is also arranged essentially parallel to the weaving plane 6 but in tangential alignment to the weaving axis 3. In this arrangement, the warp yarn 12 is thus completely removed from the warp yarn bobbin 11 without any deflection, which results in a particularly thread-protecting guide.

FIG. 4 also shows that the geometry of the circular weaving machine in accordance with the invention allows the use of weaving cores 1 with a particularly large cross-section y The radius of the weaving core 1 can reach at the maximum up to the inner radius of the rotating shuttle 5 or weft bobbins 7 or up to the inner radius of the warp coil devices 10 or warp yarn bobbins 11, depending on which part of the weaving axis 3 is closer.

Based on circular weaving machine according to FIG. 4, a weaving process is used in accordance with the weaving pattern of fabric 17 visible on the weaving core 1*b*, in which the positioning devices 13 are controlled in such a way that the warp bobbins 11 change their position only after three shuttle passes (through the first shuttle 5, the second shuttle 5 and again through the first shuttle 5), so that the fabric produced 17 has less undulation. A fabric 17 with less undulation is particularly gentle to the fibers, since fewer fiber deflections weaken the fibers, which is particularly advantageous when using sensitive fiber material.

Figure 5:
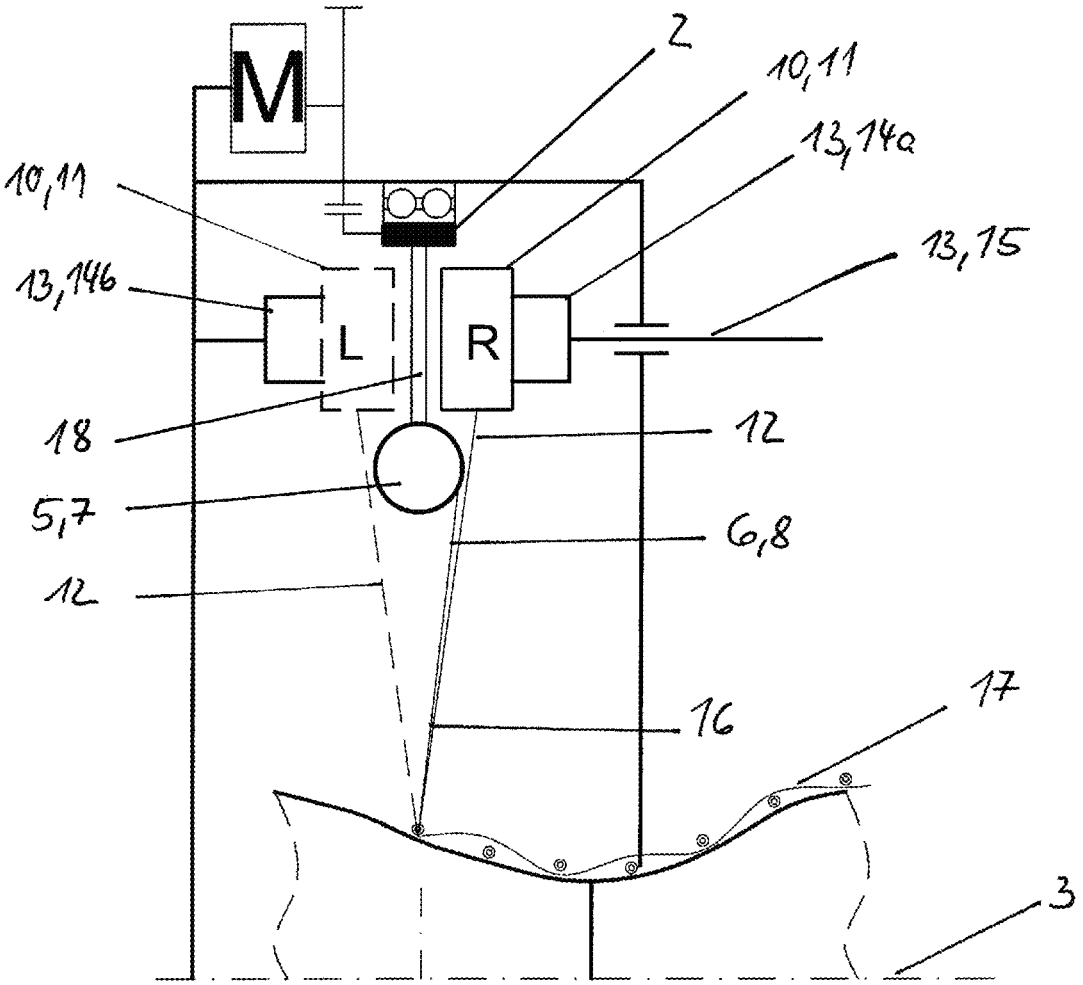
FIG. 5 A semi-profile of the circular weaving machine according to FIG. 1 with the orientation of the shuttle to the weaving axis within the radius of the inner contour of the warp coil devices.

FIG. 5 shows a semi-profile except of the circular weaving machine according to FIG. 1, 2*a, b, c* with a positioning device 13 according to FIG. 3 and with an alternative arrangement of the rotating shuttle 5 on the rotor ring 2 and in relation to the arrangement of the warp coil devices 10 with the warp yarn bobbins 11. The rotating shuttle 5 and warp coil devices 10 are located at significantly different radial heights in relation to the weaving axis 3.

Only the differences compared to the circular weaving machine according to FIG. 1, 2*a, b, c* are discussed below.

A web-shaped bracket 18 connects the shuttle 5 with the rotor ring 2 and keeps it at a certain radial distance from the weaving axis 3.

The radial distance of the outer contour of the shuttle 5 or the weft bobbin 7 from the weaving axis 3 is thus determined such that it is smaller than the radial distance of the outer contour of the warp coil device 10 or of the warp bobbin 11 facing the weaving core 1*b*.

The warp coil devices 10 and warp yarn spools 11 can thus be positioned even closer to the weaving plane 6 without colliding with the passing shuttle 5. The distance of the corpus of the warp coil devices 10 or warp yarn bobbins 11 from the weaving plane 6 is only dimensioned in such a way that the space for the passage of the web-shaped support 18 of the shuttle 5 and the passage of shuttle 5 through the narrower shed of the warp threads 12 is ensured.

This results in shorter travel distances and travel times for the warp coil devices 10 or warp yarn bobbins 11 that are axially moved by the positioning devices 13, with the corresponding possibility to increase weaving speed.

The travel distance of the movable bobbin hook 14*a* of the positioning device 13 analogue FIG. 3 is significantly shorter due to the narrower positioning relative to the corresponding stationary bobbin gripper 14*b* and enables a similarly fast position change of the warp coil device 10 or the warp yarn bobbin 11, as is the case with the design of the positioning device 13 with two interacting movable bobbin grippers 14*a* according to FIG. 2*a, b, c*.

Furthermore, this embodiment results in a particularly small weaving angle 16 for the warp yarn 12 to the weaving plane 6 with correspondingly lower fluctuations in the yarn tension.

Figure 6:
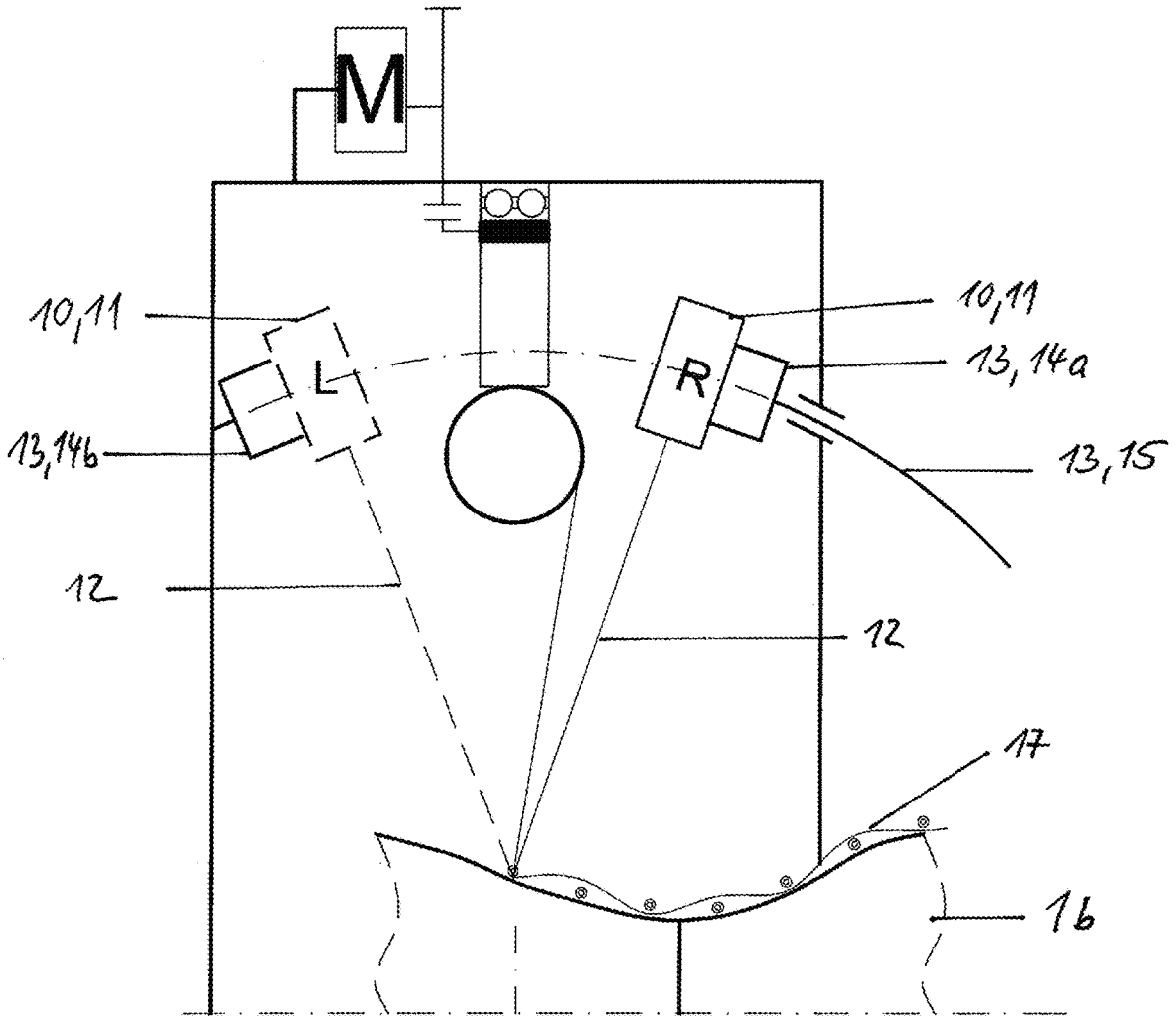
FIG. 6 A semi-profile of the circular weaving machine according to FIG. 1 with a positioning device with a circularly movable bobbin gripper.

FIG. 6 shows a semi-profile section according to FIG. 1 with positioning devices 13 for moving and positioning the warp coil devices 10 and the warp bobbins 11 respectively, analogous to the embodiment according to FIG. 5, wherein in contrast to the design according to FIG. 5, the guide rod 15 of the movable bobbin gripper 14*a* and the holder of the corresponding stationary bobbin gripper 14*b* are arranged and designed such that an arc-shaped travel path of the movable bobbin gripper 14*a* along a constant radius around the weaving point on the weaving core 1*b* instead of a linear axial travel movement is achieved.

In this embodiment, the length of warp yarn 12 between the warp bobbin 11 and the weaving point on the weaving core 1*b* remains the same at every position of the travel path of the warp bobbin 11, so that yarn tension remains constant over the entire travel path with the corresponding advantages for a fabric 17 to be produced that is permanently true to shape.

Figure 7:
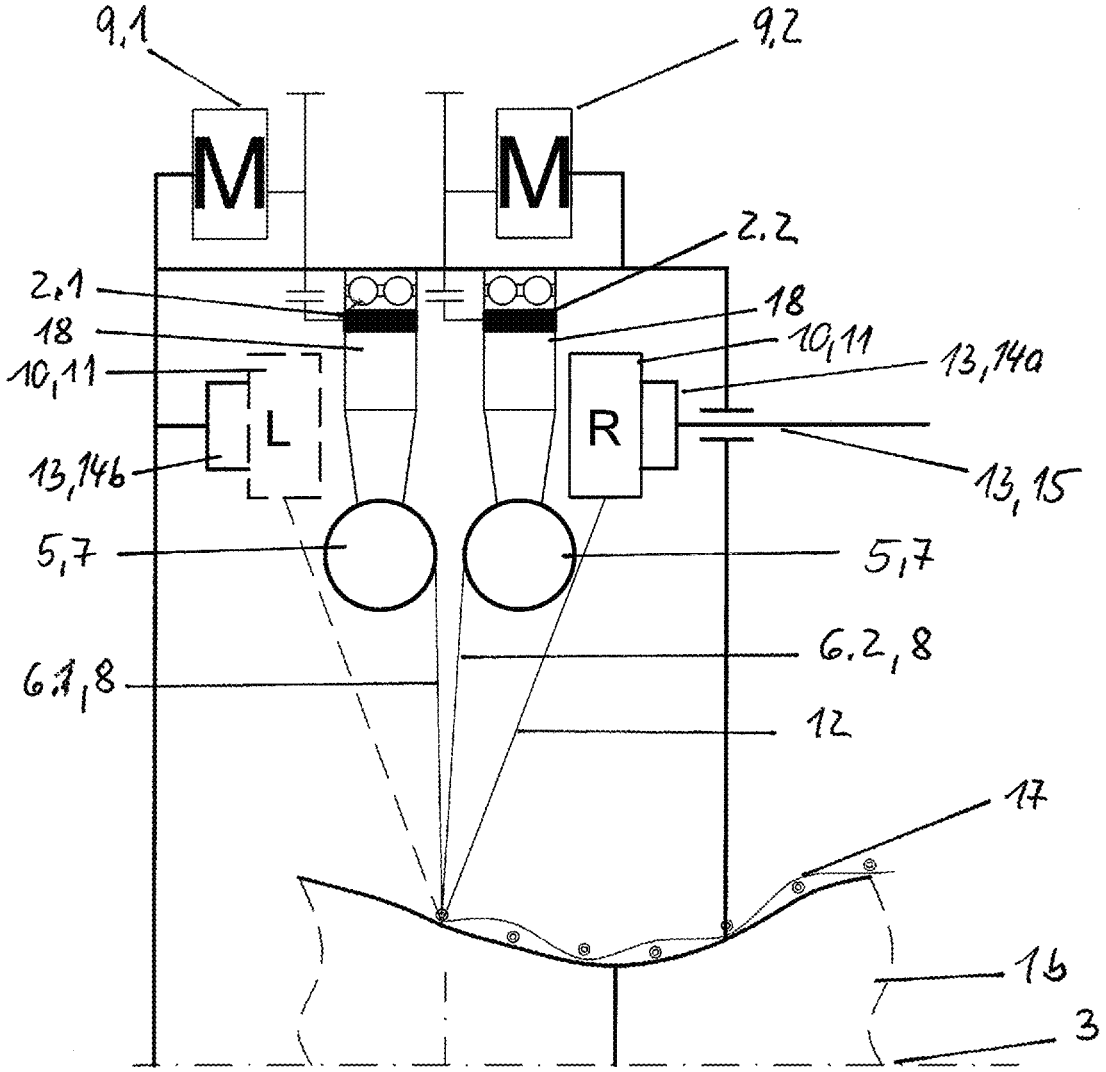
FIG. 7 A semi-profile of the circular weaving machine in accordance with the invention with two rotor rings each of which with two shuttles.

FIG. 7 shows a semi-profile section of the circular weaving machine in accordance with the invention which, unlike the circular weaving machine according to FIG. 1, 2*a, b, c*, has two rotor rings 2.1, 2.2 which are mounted rotatably on the hollow-cylindrical machine housing 4 in parallel arrangement to one another and rotate around an unevenly contoured loom core 1*b* with a variable cross-section.

Only the differences when compared to the circular weaving machine according to FIG. 1 will be discussed below.

The two rotor rings 2.1, 2.2 form two circular tracks (conveyor tracks) 2.1, 2.2 each for conveying a pair of shuttles 5, which are fastened in pairs to one rotor ring 2.1, 2.2 each via a web-type holder 18 analogous to the embodiment according to FIG. 5, 6 and are carried along with the rotary movement of the respective rotor ring 2.1, 2.2 at a constant distance from each other. Preferably, the shuttles 5 comprising the shuttle pair are offset 180° to each other and thus arranged opposite in the respective rotor ring 2.1, 2.2.

The interior space of each rotor ring 2.1, 2.2 comprises a usable weaving plane 6.1, 6.2 of the circular weaving machine. The weft yarns 8 carried by the shuttle 5 of both rotor 2.1, 2.2 run linearly to one and the same weaving point on the weaving core 1*b*, so that the weaving planes 6.1, 6.2 are essentially circular-disc-shaped and essentially parallel to each other.

The rotor rings 2.1, 2.2 can rotate in the same direction or in opposite directions and at different speeds to each other by means of separate drive 9.1, 9.2, which, in combination with the alternating warp coil devices 10 or warp bobbins 11, can produce fabric 17 with very individual weaving patterns and with different fabric properties.

This embodiment also allows several weft yarns 8 of different fiber quality to be processed together.

The circular weaving machine has positioning devices 13 for moving and positioning the warp coil devices 10 or warp bobbins 11 according to the embodiment according to FIG. 3 and an arrangement of the shuttles 5 on the rotor rings 2.1, 2.2 according to the embodiments according to FIG. 5, 6.

For alternating positioning, the warp coil device 10 or the warp yarn bobbin 11 (right position of the warp bobbin 11 marked with R) is guided axially through both weaving planes 6.1, 6.2 by means of the movable bobbin gripper 14*a* with correspondingly elongated guide rods 15 and transferred to the corresponding stationary bobbin gripper 14*b* on the left side of the two weaving planes 6.1, 6.2 and held there during an alternating cycle (left position of the warp bobbin 11 marked with L). After a shuttle 5 or several shuttles 5 of both rotor rings 2.1, 2.2 have passed through in a certain mode, the movable bobbin gripper 14*a* takes over the warp coil device 10 or the warp bobbin 11 from the stationary bobbin gripper 14*b* in a certain alternating mode and moves them back to the initial alternating position.

Figure 8A:
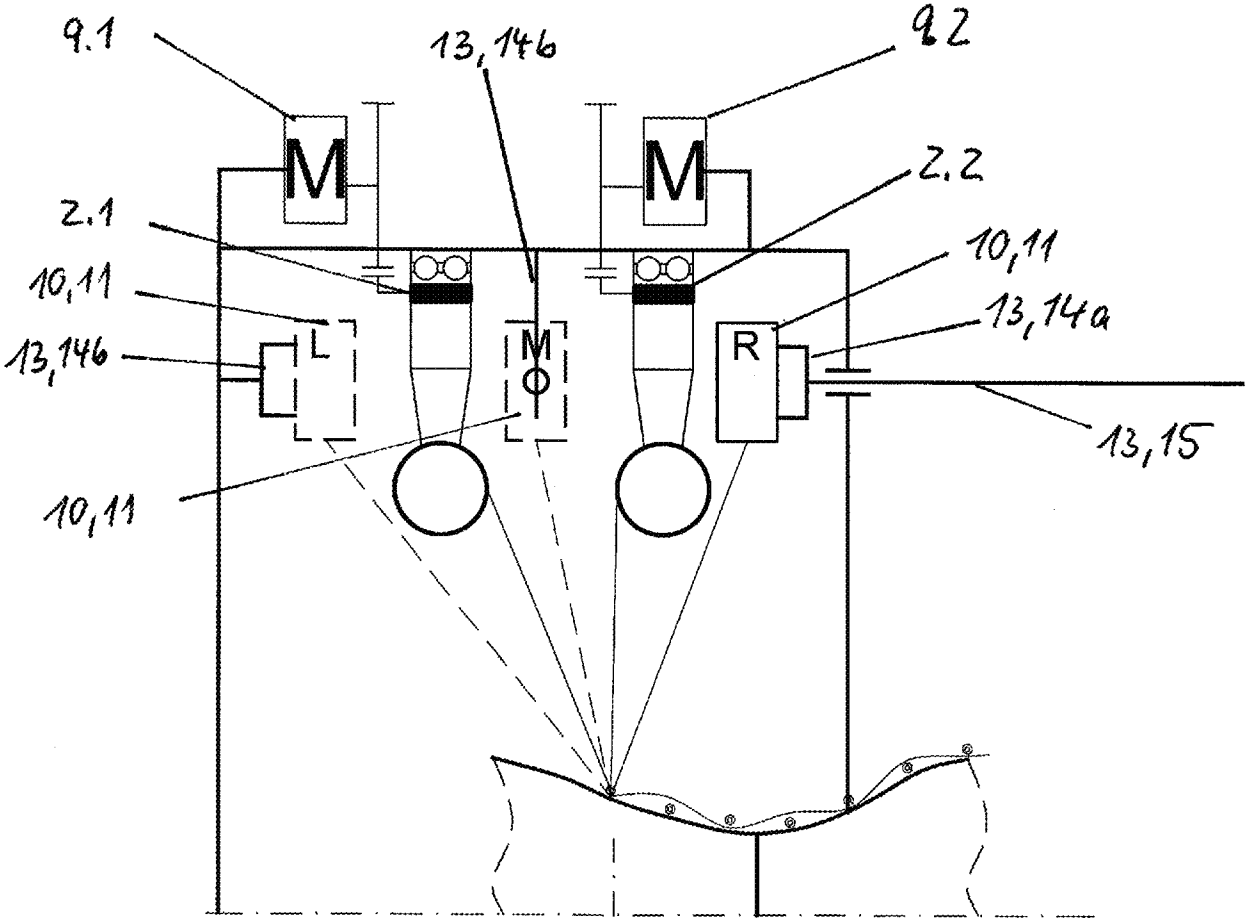
FIG. 8*a* A semi-profile of the circular weaving machine according to FIG. 7 with a first alternative positioning device.

FIG. 8*a* shows a first alternative embodiment of the circular weaving machine according to FIG. 7 with positioning devices 13, which, in contrast to the version of positioning devices 13 according to FIG. 3, each have a movable bobbin gripper 14*a* and a stationary bobbin gripper 14*b* as well as a further stationary bobbin gripper 14*b*.

The stationary bobbin gripper 14*b*, which is additional to the version according to FIG. 3, is arranged in an intermediate change position in the middle between the two rotor rings 2.1, 2.2 (position M). The movable bobbin gripper 14*a* can transfer the warp coil device 10 or the warp bobbin 11 to the stationary bobbin gripper 14*b* in the left-hand alternating position (position L) or to the stationary bobbin gripper 14*b* in the middle alternating position (position M).

This increases the variability of the change modes of the warp coil devices 10 and warp yarn bobbins 11, respectively, so that even greater flexibility in the design of the weaving patterns is achieved.

Figure 8B:
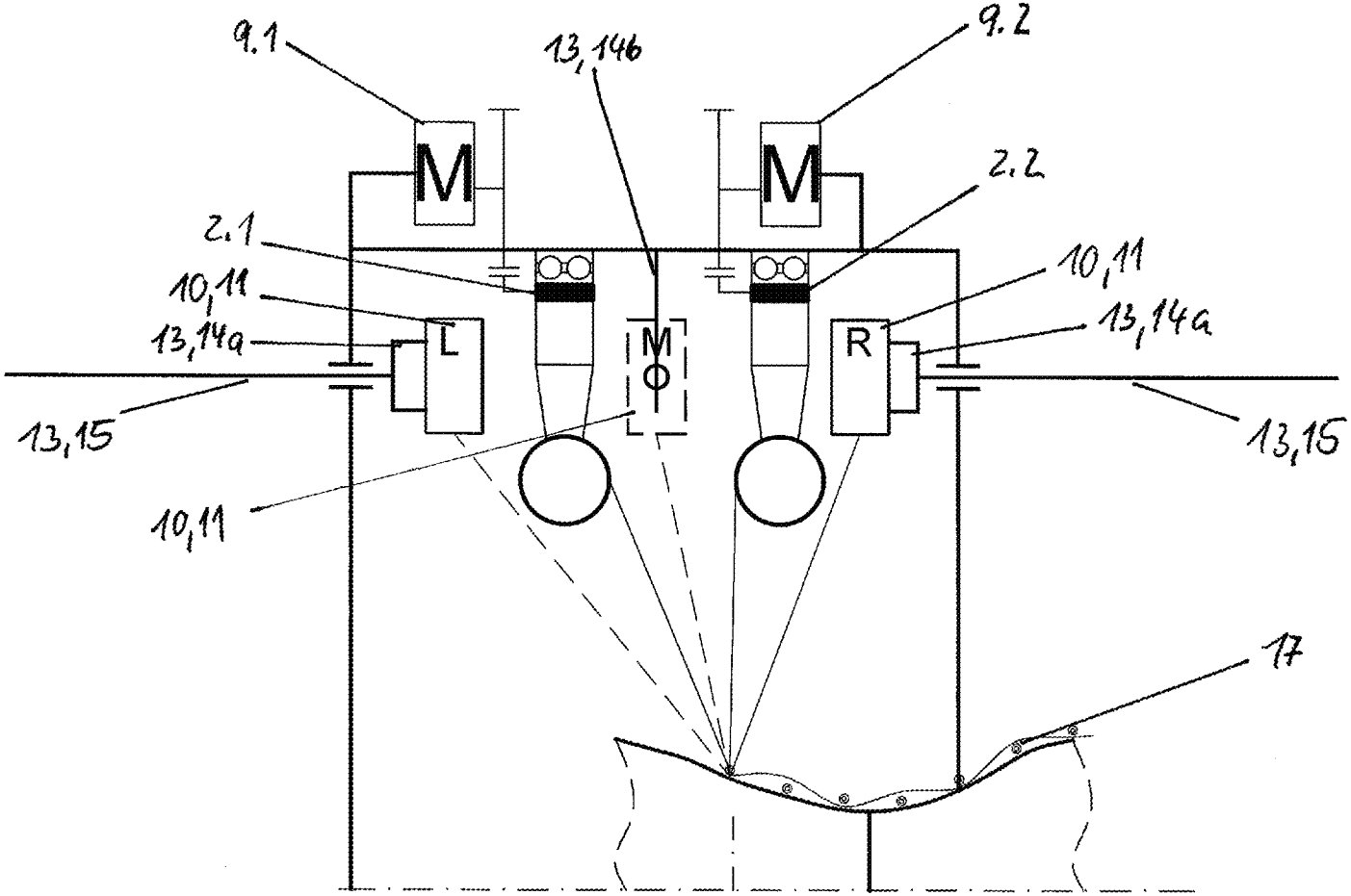
FIG. 8*b* A semi-profile of the circular weaving machine according to FIG. 7 with a second alternative positioning device with two movable bobbin grippers and a stationary bobbin gripper.

FIG. 8*b* shows a second alternative embodiment of the circular weaving machine according to FIG. 7 with positioning devices 13, which, in contrast to the version of the positioning 13 according to FIG. 1, 2*a, b, c*, have a stationary bobbin gripper 14*b* in addition to two movable bobbin grippers 14*a* each.

The additional stationary bobbin gripper 14*b*, when compared to the embodiment according to FIG. 1, 2*a, b, c*, is arranged in an intermediate change position (position M) between the two rotor rings 2.1, 2.2.

The two movable bobbin grippers 14*a* can alternately transfer a warp coil device 10 or the warp bobbin 11 in a selectable change mode to the stationary bobbin gripper 14*b* in the middle change position (position M) or to the opposite movable bobbin gripper 14*a* in the outer change position (position R, L).

In this embodiment, two warp coil devices 10 or warp bobbins 11 can be operated simultaneously by the same positioning device 13. As can be seen from FIG. 8*b*, the two warp bobbins 11 positioned at positions R and L can be transferred alternately to the stationary bobbin gripper 14*b* in the middle change position (position M) or taken over from this position.

This not only increases the variability of the change modes of the warp coil devices 10 and warp yarn bobbins 11 with subsequently increased flexibility in weaving pattern design, but also the weaving speed due to shorter and simultaneously executable transfer paths.

This double circular weaving machine with two rotor rings 2.1, 2.2 and the flexibly manageable positioning devices 13 increases the possibility of combining the applicable operating parameters, materials and weaving modes to create fabric 17 with the most diverse weaving patterns and fabric properties.

The circular weaving machine according to the invention can be equipped with any number of rotor rings 2 or weaving planes 6 and with positioning devices 13 with any number of bobbin gripper elements.

Figure 9:
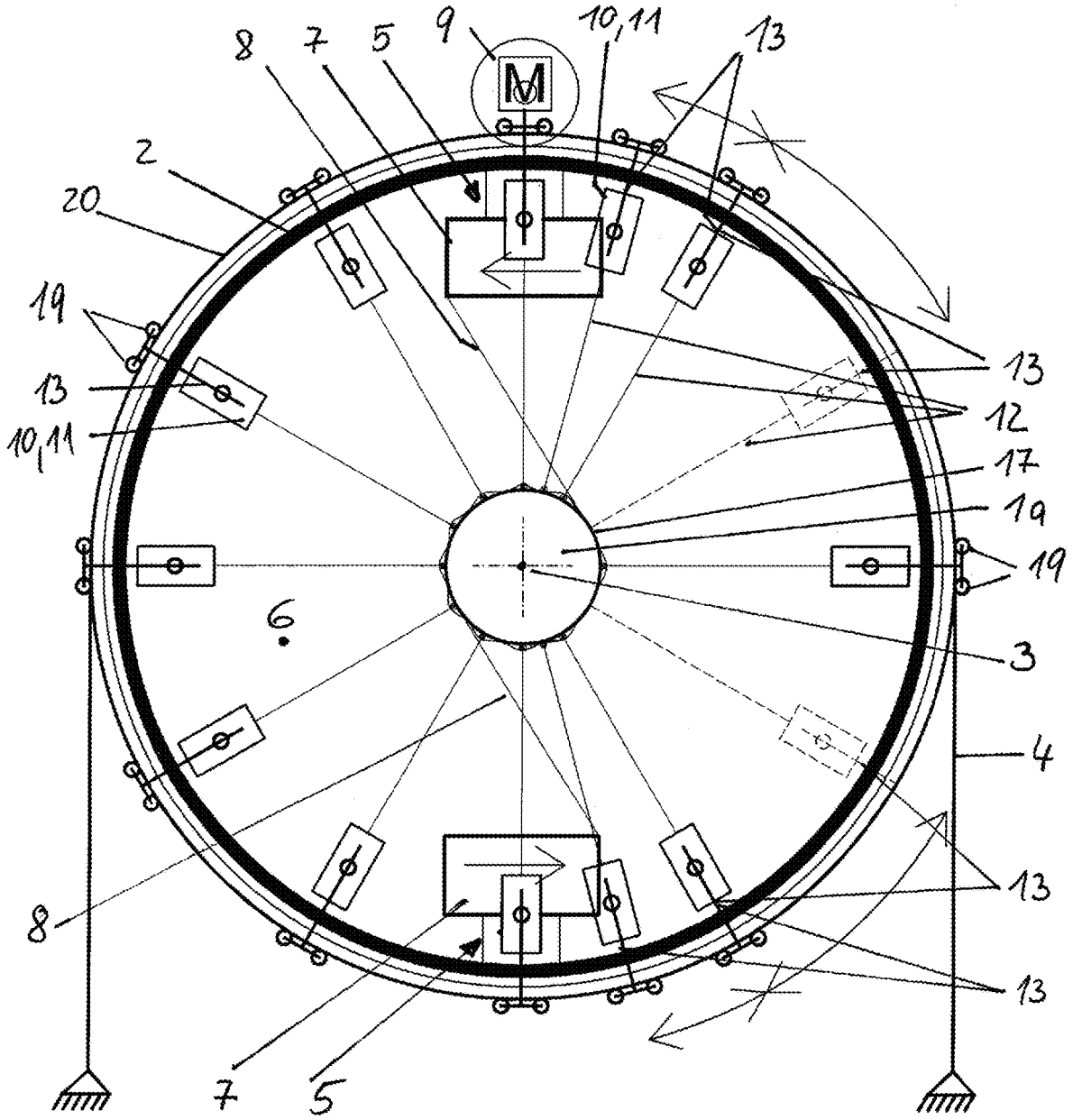
FIG. 9 A front view of a circular weaving machine in accordance with the invention with positioning devices that may be moved around the circumference of the circular weaving machine.

FIG. 9 shows a circular weaving machine which, like the circular weaving machine according to FIG. 1, has a rotor ring 2 with two shuttles 5 and twelve warp coil devices 10, each with a warp bobbin 11, which are mounted on the hollow-cylindrical machine housing 4 of the circular weaving machine by means of a positioning device 13.

In contrast to the circular weaving machine according to FIG. 1, one or more of the twelve positioning devices 13 can be moved along the circumference of the machine housing 4.

This means that the warp coil devices 10 and warp bobbins 11 can be variably displaced about the weaving axis 3 in the tangential (circumferential) direction as well as axially and parallel to the weaving axis 3 by means of the movable positioning devices 13.

Only the differences to the circular weaving machine according to FIG. 1 will be described in detail below. Identical components are marked with identical reference numbers.

The positioning devices 13, which can be moved around the circumference of the circular weaving machine, can be moved or rolled along a peripheral or sectional groove 20 by means of a slide or roller element 19 or in a perforated track in the hollow-cylindrical machine housing 4 and can each be controlled by a servomotor (not shown).

This allows the warp coil devices 10 or warp bobbins 11, which are distributed over the circumference of the circular weaving machine, to be displaced tangentially around the weaving core 1*a*, as indicated by the arrows in FIG. 9. For example, positioning device 13 can be moved from the 2 o'clock position to the 1 o'clock position and back, while adjacent positioning device 13 is moved from the 1 o'clock position to between 0 o'clock and the 1 o'clock position and back.

Furthermore, positioning devices 13 can be arranged tangentially movable on one or both sides of the weaving plane 6 formed by rotor ring 2 and weft yarns 8 on the machine housing 4.

In particular, gripper elements 14 of the positioning device 13 that are arranged on the machine housing 4 either fixed to the frame or tangentially movable on one side of the weaving plane 6 can work in cooperation with gripper elements 14 of the positioning device 13 that are arranged either fixed to the frame or tangentially movable on the other side of the weaving plane 6 (not shown).

This results in particular that, for purposes of the iterating change of the warp yarns 12, stationary bobbin grippers 14*b*, or bobbin grippers 14*a* of a positioning device 13 that may be axially moved through the weaving plane 6 with stationary bobbin grippers 14*b* or bobbin grippers 14*a* that may be axially moved through the weaving plane 6 of adjacent positioning devices 13 come into operative contact.

The flexible rotational positions and combination possibilities of the corresponding gripper elements 14 of the positioning devices 13 allow a variable path for the warp yarns 12 in relation to the weaving axis 3 and thus any bundle or gap arrangements of the warp yarns 12 woven with the weft yarns 8 on the weaving core 1 a to generate, for example, openings or reinforcements in the fabric 17—as indicated in FIG. 9—mechanically and with little effort.

Figure 10:
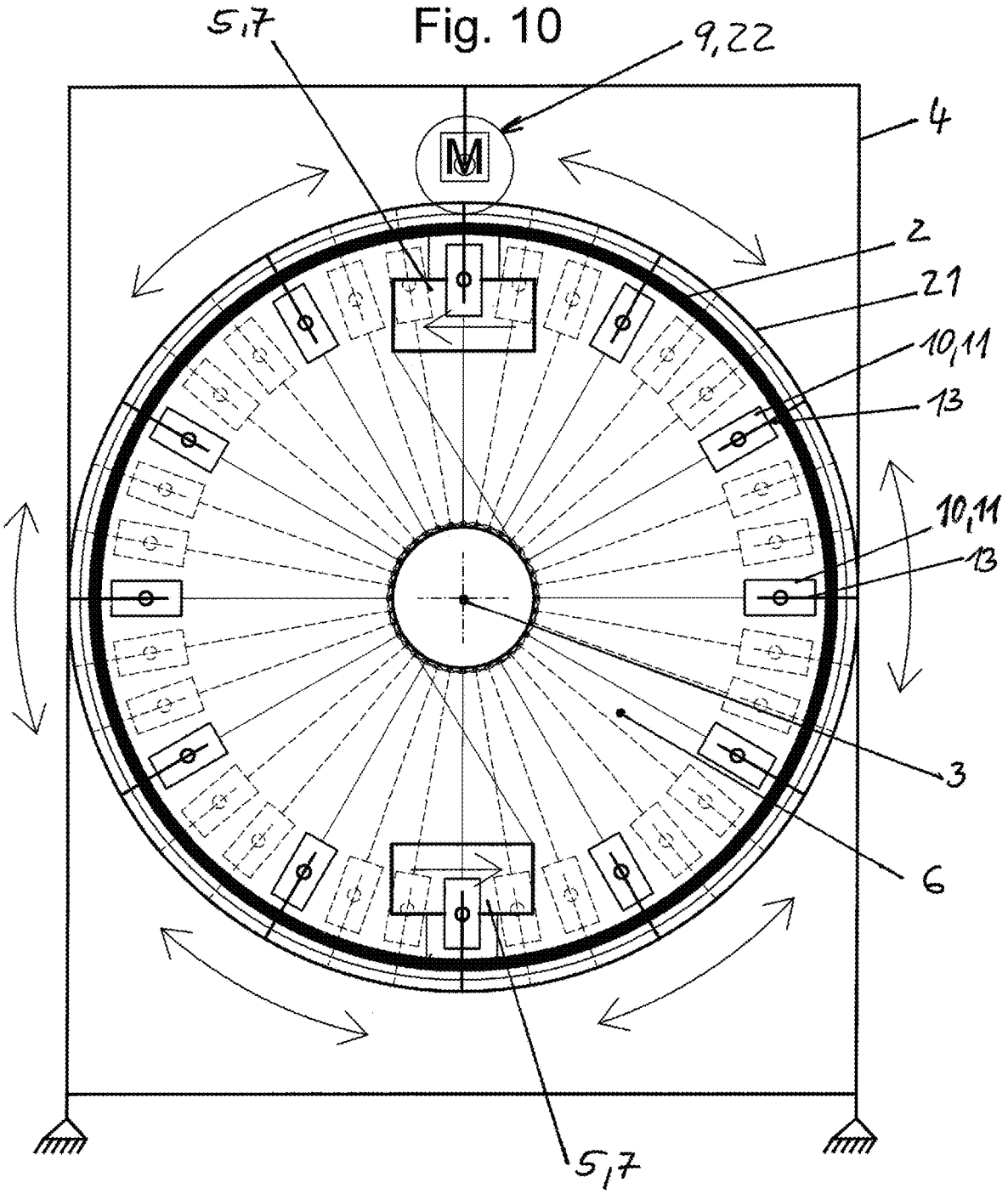
FIG. 10 A front view of a circular weaving machine in accordance with the invention with positioning devices arranged on at least one rotatably mounted warp bobbin ring.

In contrast to the circular weaving machine according to FIG. 10, the circular weaving machine according to FIG. 9 has at least one warp bobbin ring 21 which is rotatably mounted on a box-shaped machine housing 4 and on which some of the positioning devices 13 or all twelve positioning devices 13 are arranged. These positioning devices 13 or further positioning devices 13 can alternatively be arranged distributed across several warp bobbin rings 21.1, 21.2, 21.3, 21.4 as can be seen from the view according to FIG. 11.

The warp bobbin ring 21 or the warp bobbin rings 21.1, 21.2, 21.3, 21.4 is/are arranged sideways of weaving plane 6 limited by the rotor ring 2 and are each mounted concentrically about the weaving axis 3 on the machine housing 4. The pivot bearing for the warp bobbin ring 21 or the warp bobbin rings 21.1, 21.2, 21.3, 21.4 is provided in the illustrative embodiment analogous to the pivot bearing of the rotor ring 2 by means of a roller bearing attached to the machine housing 4 (shown in FIG. 11).

Each warp bobbin ring 21.1, 21.2, 21.3, 21.4 is separately driven and controlled by a motor 22 and a gear drive, so that these are moved in a certain mode (cyclically or continuously, clockwise or counter-clockwise) with the positioning devices 13 located thereon and the positioning devices 13 can assume any desired rotary position around the circular weaving machine, as indicated by the arrows in FIG. 10.

The warp coil devices 10 with the warp bobbins 11 can be moved axially and thus parallel to the weaving axis 3 on the one hand and, on the other, in tangential (rotary) direction around the weaving axis 3, by means of the continuously movable positioning devices 13.

The gripper elements 14 of the positioning devices 13 mounted rotatably in this way can be combined on one or both sides of weaving plane 6 with gripper elements 14 of positioning devices 13 arranged fixed to the frame (not shown).

For example, bobbin grippers 14 of the positioning devices 13 can be arranged on one side of the weaving plane 6 on a warp bobbin ring 21 and the corresponding bobbin grippers 14 of these positioning devices 13 on the other side of the weaving plane 6 can be fixed to the frame of machine housing 4 (not shown).

Figure 11:
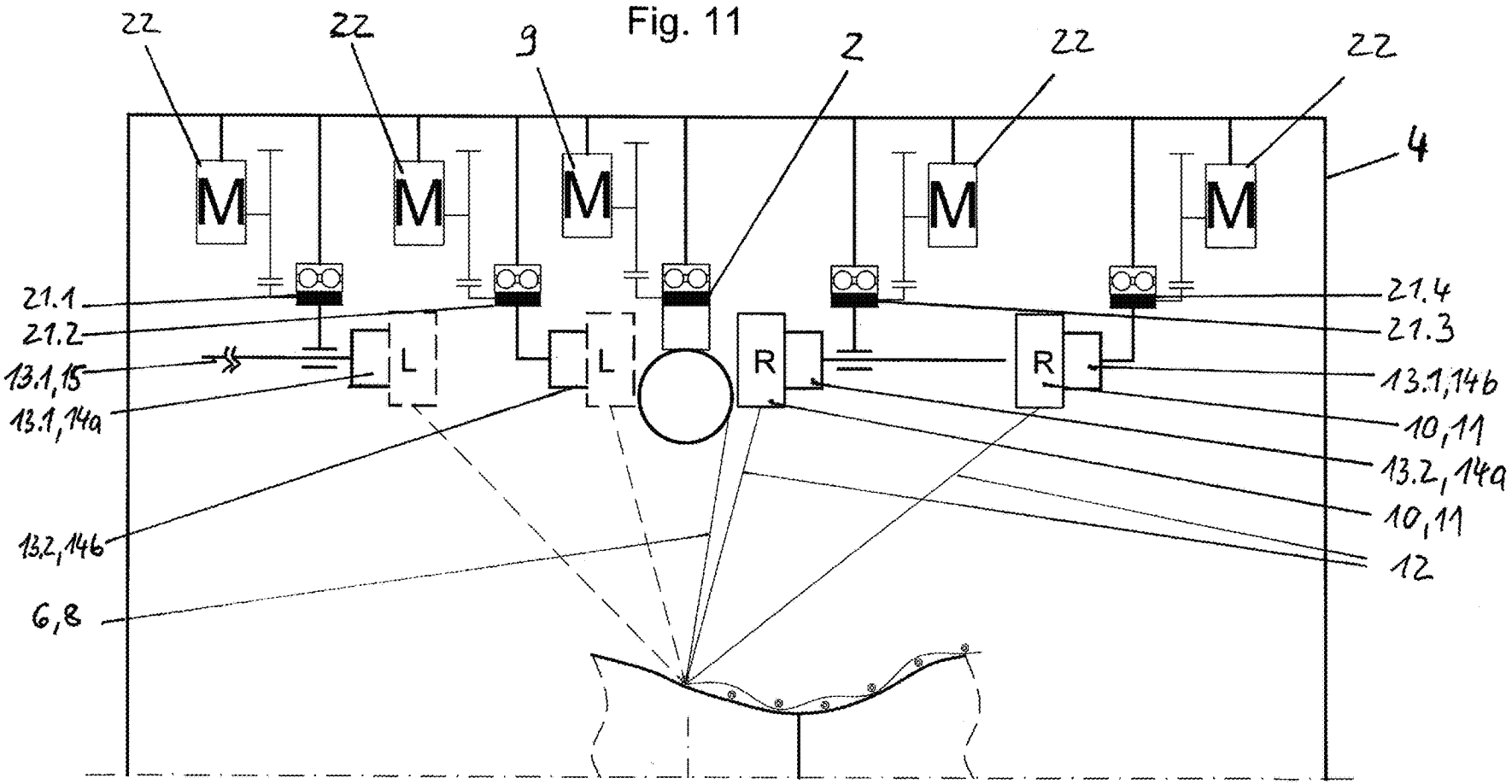
FIG. 11 A semi-profile of the circular weaving machine according to the variant depicted in FIG. 10 with several warp bobbin rings.

As shown as an example in FIG. 11 in a semi-profile view of the circular weaving machine according to FIG. 10, the positioning devices 13 can be arranged on warp bobbin rings 21.1, 21.2, 21.3, 21.4 mounted on both sides of the weaving plane 6, it being possible to move the warp bobbin rings 21.1, 21.2, 21.3, 21.4 cyclically or continuously at the same or different speed and in the same or opposite direction to each other.

In both cases, stationary, or bobbin grippers 14*a*, 14*b* that are axially moveable through the weaving plane 6, of a positioning device 13 with stationary, or bobbin grippers 14*a*, 14*b* that are axially moveable through the weaving plane 6, of adjacent positioning devices optionally come into operative connection for iterating change of the warp yarns 12.

The multitude of rotational positions and possible combinations of the gripper elements 14 (bobbin gripper 14) of the positioning devices 13 allow a particularly high variability of the course of the warp threads 12 during weaving with weft yarns 8 and thus an extraordinarily high degree of possible weaving patterns.

FIG. 11 illustrates in detail a possible variant of the circular weaving machine according to FIG. 10 with two warp bobbin rings 21.1, 21.2, 21.3, 21.4 each mounted rotatably on both sides of the weaving plane 6 on the machine housing 4, i.e. two warp bobbin rings 21.1, 21.2 are located in the image plane to the left of the rotor ring 2 and the associated weaving plane 6 and two warp bobbin rings 21.3, 21.4 are located to the right.

On each bobbin ring 21.1, 21.2, 21.3, 21.4, twelve warp coil devices 10 with one warp bobbin 11 each can be arranged by means of a positioning device 13 as an example.

For the sake of clarity, only two positioning devices 13.1, 13.2 in the 12 o'clock position of the circular weaving machine are shown in FIG. 11.

Each positioning device 13.1, 13.2 provides an axially movable bobbin gripper 14*a* and a stationary bobbin gripper 14*b*, which are arranged on both sides of the rotor ring 2 on a warp bobbin ring 21.1, 21.2, 21.3, 21.4.

The axially movable bobbin gripper 14*a* of the first positioning device 13.1 is arranged on the outer left warp bobbin ring 21.1 (in the outer left image plane). The corresponding stationary bobbin gripper 14*b* arranged on the other side and opposite of the weaving plane 6 is arranged on the outer, right warp bobbin ring 21.4 (in the image plane on the right outside).

The axially movable bobbin gripper 14*a* of the second positioning device 13.2 is arranged on the inner right warp bobbin ring 21.3 (inside right in the image plane). The corresponding stationary bobbin gripper 14*b* arranged on the other side and opposite of the weaving plane 6 is arranged on the inner left coil device 21.2 (inside left in the image plane).

The axially movable bobbin grippers 14*a* of the positioning 13.1, 13.2 and the warp bobbin rings 21.1, 21.2, 21.3, 21.4 can be individually controlled and can move or rotate in any cycles.

In the current position of the warp bobbin rings 21.1, 21.2, 21.3, 21.4 and the bobbin grippers 14*a*, 14*b* of the two positioning devices 13.1, 13.2 according to FIG. 11, the warp coil devices 10 and warp bobbins 11 are held by the bobbin grippers 14*a*, 14*b* of the two positioning 13.1, 13.2, which are mounted on the two warp bobbin rings 21.3, 21.4 arranged in the image plane to the right of the weaving plane 6 (right position of the warp bobbins 11 marked with R).

The warp coil device 10 or warp bobbin 11 located in the current position shown on the inner right warp bobbin ring 21.3 (in the image plane on the right inside) can be positioned alternately by means of the movable bobbin gripper 14*a* of the second positioning device 13.2 are transferred through weaving plane 6 both to the directly corresponding stationary bobbin gripper 14*b* on the inner left bobbin ring 21.2 (in the image plane left inside) and to the movable bobbin gripper 14*a* of the first positioning device 13.1 on the outer, left bobbin ring 21.1 (in the image plane left outside) (left position of the warp bobbin 11 each marked with L).

From there, the warp coil device 10 or warp bobbin 11 can subsequently be taken over again by the directly corresponding movable bobbin gripper 14*a* of the second positioning device 13.2 (or a tangentially adjacent positioning device 13) of the inner right-hand warp bobbin ring 21.3 or by the movable bobbin gripper 14*a* of the first positioning device 13.1 on the outer, left-hand warp bobbin ring 21.1 to the directly corresponding stationary bobbin gripper 14*b* of the first positioning device 13.1 (or to a tangentially adjacent positioning device 13) on the outer right warp coil device 21.4 (in the image plane on the right outside) or also to the movable bobbin gripper 14*a* of the second positioning device 13.2 (or to a tangentially adjacent positioning device 13) on the inner right warp coil device 21.3 (not shown).

Similarly, the warp coil device 10 or warp bobbin 11 held by the stationary bobbin gripper 14*b* of the first positioning device 13.1 on the outer right warp coil device 21.4 in currently-shown setting shown in FIG. 11 can be taken over by the directly corresponding movable bobbin gripper 14*a* on the outer left warp coil device 21.1 through the weaving plane 6 for their alternating positioning (left position of the warp yarn package marked with L).

From there, the warp coil device 10 or warp bobbin 11 can subsequently be returned to the corresponding stationary bobbin gripper 14*b* of the first positioning device 13.1 (or a tangentially adjacent positioning device 13) on the outer right warp bobbin ring 21.4 or also transferred to the movable bobbin gripper 14*a* of the second positioning device 13.2 (or a tangentially adjacent positioning device 13) on the inner right warp bobbin ring 21.3 (not shown).

By the relative movement of the warp bobbin rings 21.1, 21.2, 21.3, 21.4 relative to each other, the stationary or axially movable bobbin grippers 14*a*, 14*b* of the circumferentially adjacent positioning devices 13 optionally engage with each other during the alternating positioning of a warp coil device 10 with the warp bobbin 11.

The above description of the possible process sequences on the circular weaving machine according to FIG. 11 illustrates all the more the high application variability of the circular weaving machine in accordance with the invention.

Figure 12:
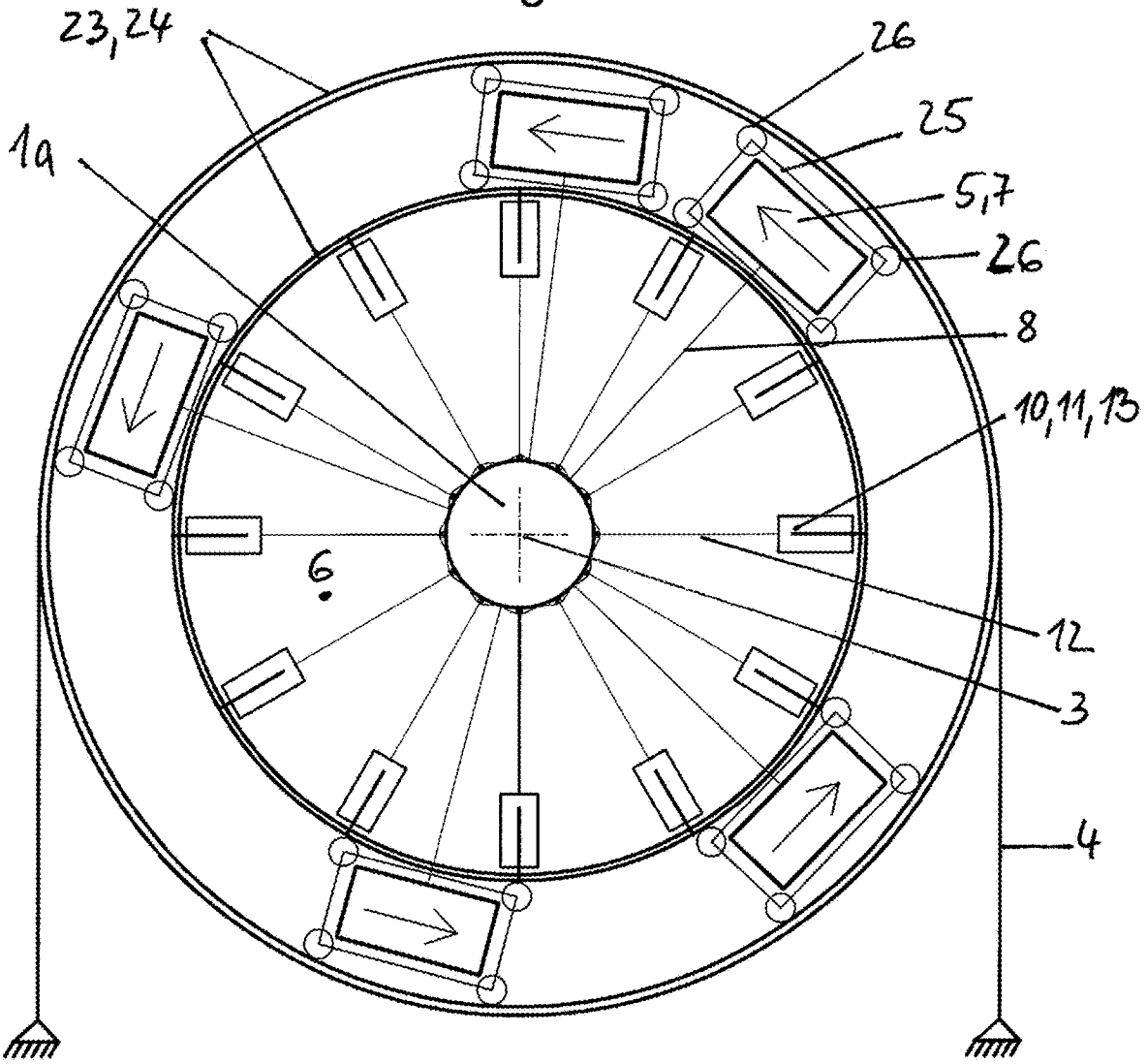
FIG. 12 A front view of a circular weaving machine in accordance with the invention with a multi-part, annular guide track on which five shuttle frames are guided.

FIG. 12 shows an alternative circular weaving machine compared to the circular weaving machine according to FIG. 1, which instead of a rotor 2 has a circular, multi-part guide track 23 with four sub-tracks 24 that are arranged concentrically and firmly fit around a cylindrical weaving core 1*a*.

Identical function elements are marked with identical reference characters.

Five shuttles 5 are guided along the guide track 23, each of which is arranged in a cubic shuttle carriage 25, which has eight guide rollers 26 each, of which two guide rollers 26 are each assigned to a sub-track 24 of the guide track 23. By means of shuttle carriages 25, the shuttles 5 circulate within the multi-part guide track 23 that forms the circular continuous track 23 for guiding the rotating shuttles 5 (guide track) and defines the line of travel for the shuttles 5.

The two inner sub-tracks 24 of the multi-part guide track 23 pointing in the direction of the weaving axis 3 limit the radially extended interior of the circular continuous track 23 and thus the radial extension of the usable weaving plane 6 of the circular weaving machine, with the shuttle 5 rotating outside the weaving plane 6.

Figure 13:
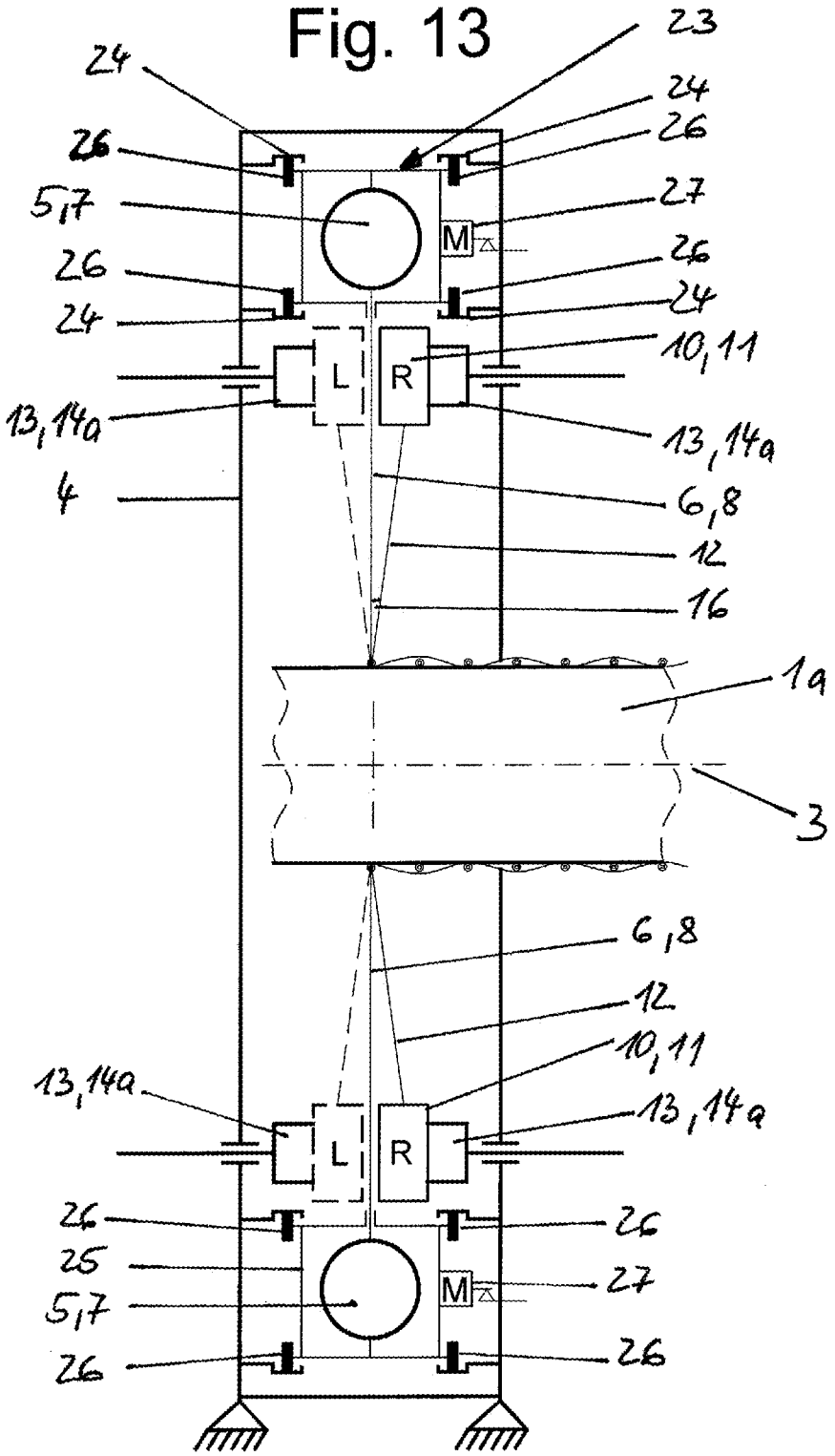
FIG. 13 A profile view of the circular weaving machine according to FIG. 12.

The shuttles 5 each have a weft bobbin 7, the weft yarn 8 of which is guided in a straight line between the two radially inner sub-tracks 24 to the weaving point on the weaving core 1*a* (clearly visible in FIG. 13). The weaving plane 6 in the radial interior of the annular guide track 23 is therefore essentially circular-disc-shaped—determined in part by the course of the weft yarns 8.

Twelve warp coil devices 10 are arranged concentrically around the weaving core 1*a*, and at the same distance from each other, with one warp bobbin 11 each, which are movably mounted on the machine housing 4 by means of one positioning device 13 each. The warp yarn 12 of the warp bobbins 11 also guide the weaving core 1*a* in a straight line and at a variable weaving angle 16 opposite the weaving plane 6 to the weaving point on the weaving core 1*a*.

Each shuttle 5 is driven separately by a motor 27 attached to the shuttle carriage 25, which receives the current and the control commands via a slip ring contact from a corresponding slip ring (shown in FIG. 13).

The shuttles 5 can therefore roll independently of each other at the same or at different speeds within the guide track 23.

The positioning devices 13 for moving and positioning the warp coil devices 10 and warp bobbins 11 are designed analogously to the positioning devices 13 of the circular weaving machine according to FIG. 1, 2*a, b, c* and position the warp coils devices 10 and the warp bobbins 11, respectively, as shown in FIG. 13, on both sides of the weaving plane 6 enclosed by the two radially inner sub-tracks 24 of the guide track 23 and formed by the revolving weft threads 8.

For the sake of clarity, only the shuttles 5 and positioning devices 13 in the 6 o'clock and 12 o'clock positions are shown in FIG. 13.

As with the circular weaving machine according to FIG. 1, the axis of rotation of the weft bobbin 7 is arranged in the circumferential direction of the shuttle 5, while the axis of rotation of the warp bobbin 11 is arranged essentially parallel to the weaving plane 6 and perpendicular to the weaving axis 3, so that the feed of the weft yarn 8 and the warp yarn 12 to the weaving core 1*a* is largely accomplished with few or no deflections.

For purposes of the iterating change of warp yarns 12, each warp coil device 10 or each warp yarn bobbin 11 is guided through the weaving plane 6 in both directions by means of the axially movable bobbin grippers 14 a of the positioning devices 13.

Since the shuttles 5 are arranged in the inner installation space of the multi-part guide track 23 and thus run outside the weaving plane 6 enclosed by the radially inner sub-tracks 24 of the guide track 23, the lateral position of the warp coil device 10 with the warp bobbin 11 is not influenced by the required circulation space of the shuttles 5. The warp coil device 10 with the warp bobbin 11 only has to allow the weft yarns 8 to pass within the weaving plane 6 and can therefore be positioned as close as possible to the weaving plane 6; this is associated with the benefits of a very short alternating travel path for the warp coil device 10 or the warp bobbin 11 and a very small weaving 16.

By the alternating spreading of the warp yarns 12, while the five shuttles 5 rotate in symmetrical or asymmetrical distances to each other in the guide track 23, the warp yarns 12 are woven with the weft yarns 8 in the desired weaving structure, whereby the uniform weaving mode shown in FIG. 12, 13 can also be changed during the weaving process by means of the individual drive and the control of the shuttle 5 and the bobbin grippers 14*a* of the positioning devices 13.

Shuttle 5, which is securely guided in the grooves of the sub-tracks 24 of the guide track 23 by means of the shuttle carriage 25, can apply a particularly high thread tension to the weft yarn 8 which is carried along and enables the weaving core 1*a* to be woven with a very strong fabric 17.

According to this illustrative embodiment, the circular weaving machine is therefore particularly suitable for weaving an unevenly contoured weaving core 1*b* with contour-conforming fabrics 17 in accordance with the illustrative embodiments described above.

Figure 14:
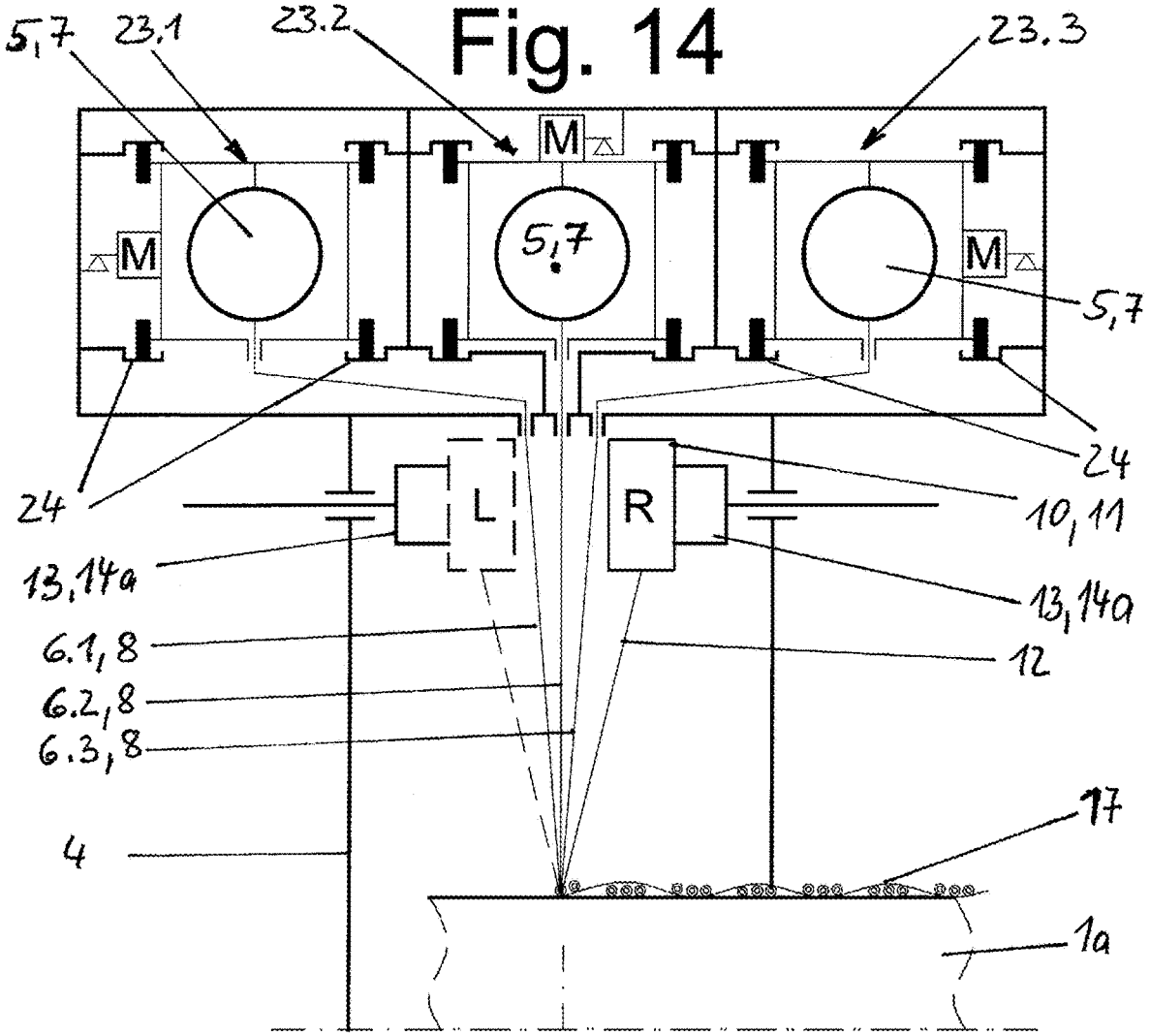
FIG. 14 A semi-profile of the circular weaving machine in accordance with the invention with three multi-part annular guide tracks each of which with two shuttles.

FIG. 14 shows a semi-profile section of an expanded circular weaving machine, which is constructed similarly to the circular weaving machine according to FIG. 12, 13 but has three multi-part, annular guide tracks (guide tracks) 23.1, 23.2, 23.3, which are arranged parallel to one another. Each of the multi-part guide tracks 23.1, 23.2, 23.3 is constructed according to guide track 23 according to FIG. 12, 13 and is equipped with two shuttles 5 (pair of shuttles), which rotate inside the multi-part guide track 23.1, 23.2, 23.3.

Only the differences compared to the embodiment of the circular weaving machine according to FIG. 12, 13 will be discussed below.

The multi-part, circular guide tracks 23.1, 23.2, 23.3 each form a circular continuous track, (guide track) 23 and define the parallel guide tracks for the shuttle 5.

The two inner sub-tracks 24 of the guide tracks 23.1, 23.2, 23.3 pointing in the direction of the weaving axis 3 each radially limit the potentially usable weaving plane 6.1, 6.2, 6.3, with the shuttle 5 rotating outside these weaving planes 6.1, 6.2, 6.3.

From the shuttle 5 of the middle guide track 23.2, the weft yarns 8 for weaving the weaving core 1*a* are guided in a straight line between the associated inner sub-tracks 24 to the weaving point on the weaving core 1*a*.

The weft yarns 8 of the two flanking guide tracks 23.1, 23.3 are each guided over a yarn deflection in order to subsequently also run in a straight line to the weaving point on the weaving core 1*a*.

The thread deflections of the two flanking guide tracks 23.1, 23.3 serve to bring the weft yarns 8 of the parallel rotating shuttle 5 closer together and thus to combine the three weaving planes 6.1, 6.2, 6.3 determined by the guide tracks 23.1, 23.2, 23.3 and the travel of the weft yarn.

The positioning devices 13 for moving and positioning the warp coil devices 10 or the warp bobbins 11 are designed analogously to the positioning devices 13 of the circular weaving machine according to FIG. 1, 2*a, b, c* or according to FIGS. 12 and 13, whereby the warp coil devices 10 or the warp bobbins 11 are positionable on both sides of the three combined weaving planes 6.1, 6.2, 6.3 respectively.

For the sake of clarity, only the three parallel sliding shuttles 5 and one positioning device 13 are shown in FIG. 14 in the 12 o'clock position of the circular weaving machine.

The warp yarns 12 of the warp bobbins 11 travel linearly and with a variable weaving angle 16 to the weaving planes 6.1, 6.2, 6.3. to the weaving point on the weaving core 1*a*, wherein for alternating spreading of the warp yarns 12 each warp coil device 10 or each warp yarn bobbin 11 is guided simultaneously in both directions through the three weaving planes 6.1, 6.2, 6.3. by means of the movable bobbin grippers 14*a* of the positioning device 13. The combination of weaving levels 6.1, 6.2, 6.3. reduces the travel distance required for changing the position of the warp coil device 10 or the warp bobbin 11.

The weaving core 1*a* according to FIG. 14 shows an example of a fabric 17 produced with a weaving pattern in which the weaving mode provides for a warp yarn change after the passage of three shuttles 5, so that three weft yarns windings are woven simultaneously with one warp yarn 12.

This weaving mode can be generated in different operating modes of the circular weaving machine, for example in the operating mode in which one shuttle 5 is passed through each of the three parallel guide tracks 23.1, 23.2, 23.3 between the warp yarn change. A further mode of operation is possible in which, between the warp yarn change, a fast rotating shuttle pair 5 passes on the middle guide track 23.2 and a relatively slow rotating shuttle 5 passes on the left adjacent guide track 23.1. In a second cycle after the warp yarn change, during the repeated passage of the fast rotating shuttle pair 5 on the middle guide track 23.2, the passage of the relatively slow rotating shuttle 5 follows on the adjacent guide track 23.3 on the right.

Using the parallel guide tracks 23.1, 23.2, 23.3, shuttle 5 can be operated side by side at very different speeds, which is particularly important when processing weft yarns 8 of different weaving materials.

The shuttles 5 operated in the parallel guide tracks 23.1, 23.2, 23.3 can also rotate in the same direction of rotation or in the opposite direction, depending on the desired fabric properties.

With this expanded circular weaving machine, the ability to combine the applicable operating parameters and thread materials to achieve a wide variety of weaving patterns and fabric properties is further increased.

Figure 15:
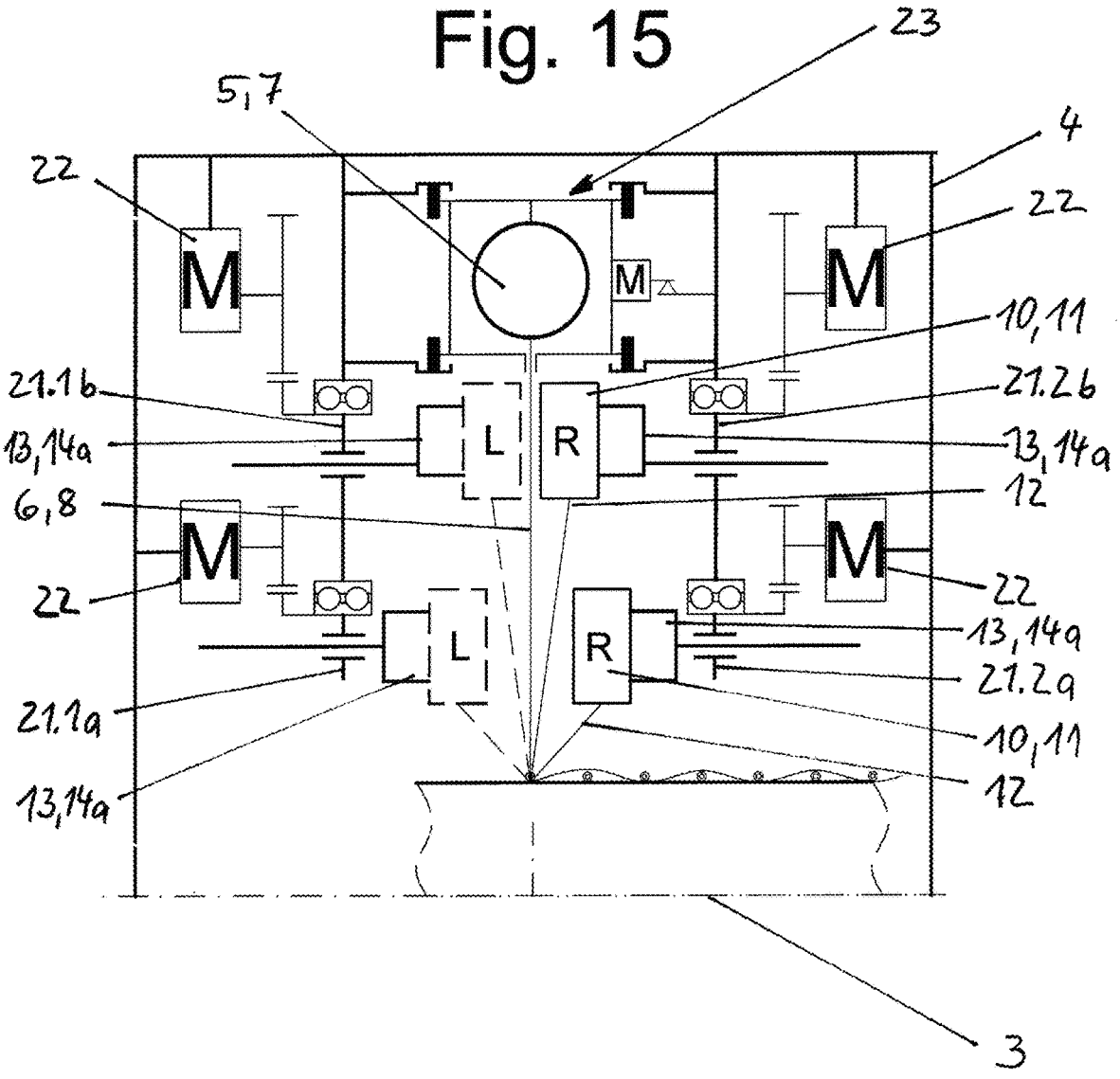
FIG. 15 A semi-profile of the circular weaving machine in annular guide track with several warp bobbin rings.

FIG. 15 shows a semi-profile section of a circular weaving machine which is constructed similar to the circular loom according to FIG. 12, 13, but provides a different number and arrangement of positioning devices 13.

The differences compared to the embodiment of the circular weaving machine according to FIG. 12, 13 will be discussed in particular below.

This circular weaving machine has two warp bobbin rings 21.1*a*, 21.1 *b* and 21.2*a*, 21.2 *b* on each side of weaving plane 6 formed by the multi-part guide track 23 and the course of the weft yarns 8, which may be concentrically and cascade-like rotated about the weaving axis 3.

The respective radially inner warp bobbin ring 21.1*a*, 21.2*a* on each side of weaving plane 6 is rotatably mounted by means of a central rolling bearing relative to the respective radially outer warp bobbin ring 21.1 *b*, 21.2 *b*, while the respective radially outer warp bobbin ring 21.1 *b*, 21.2 *b* is rotatably mounted relative to the radially inner warp bobbin ring 21.1*a*, 21.2*a* by means of the central rolling bearing and relative to the machine housing 4 by means of an outer rolling bearing.

Each of the warp bobbin rings 21.1*a*, 21.1 *b*, 21.2*a*, 21.2 *b* is separately driven and controlled by one motor 22 each.

Positioning devices 13 are arranged all around the warp bobbin rings 21.1*a*, 21.1 *b* and 21.2*a*, 21.2 *b*, which are each designed with two axially movable bobbin grippers 14*a*, 14*a* in accordance with the design according to FIG. 12, 13.

For the sake of clarity, only the shuttle 5 and the two positioning devices 13 in the 12 o'clock position of the circular loom are shown in FIG. 15.

The positioning devices 13, which are arranged on the cascade-like warp bobbin rings 21.1*a*, 21.1 *b* and 21.2*a*, 21.2 *b*, are thus arranged in two radially staggered circular planes concentrically around the weaving axis 3 and on both sides of weaving plane 6 and realize both the axial movement and the circumferential movement of the warp coil devices 10 and warp bobbins 11 with the aforementioned advantages.

The cascade-like warp bobbin rings 21.1*a*, 21.1 *b* and 21.2*a*, 21.2 *b* also allow many warp coil devices 10 and warp bobbins 11 to be arranged in the narrowest space, thus favouring a particularly narrow design for the circular weaving machine.

Figure 16:
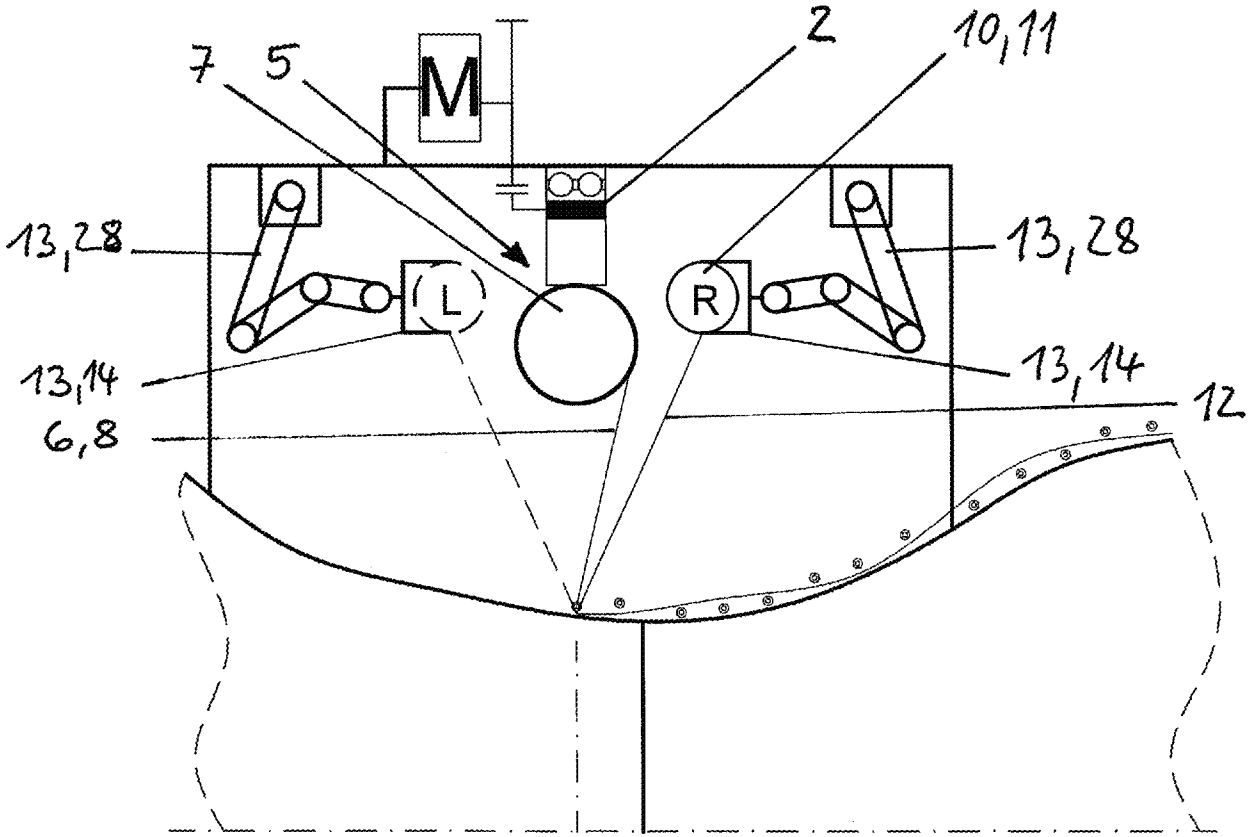
FIG. 16 A semi-profile of the circular weaving machine in accordance with the invention with one rotor ring and with a handling robot equipped with positioning devices.

FIG. 16 shows a circular loom with a rotor ring 2 and two shuttles 5 rotating with the rotor ring 2 similar to the embodiment of the rotor ring 2 according to FIGS. 1 to 4.

For the sake of clarity, only the shuttle 5 and the two positioning devices 13 in the 12 o'clock position of the circular loom are shown in FIG. 16.

In contrast to the circular weaving machine according to FIG. 1, the gripper elements/bobbin grippers 14 of the positioning devices 13 arranged on both sides of weaving plane 6 are individually guided by means of a handling robot 28.

In this embodiment of the positioning devices 13, each warp coil device 10 or warp bobbin 11 can be moved autonomously and in any axial, radial and circumferential direction to the weaving axis 3 and can be positioned at any point laterally of the weaving plane 6.

The handling robots 28 allow maximum degrees of freedom for the positioning of the warp bobbins 11 on both sides of weaving plane 6 and for the travel of the warp bobbins 11 through weaving plane 6.

Figure 17:
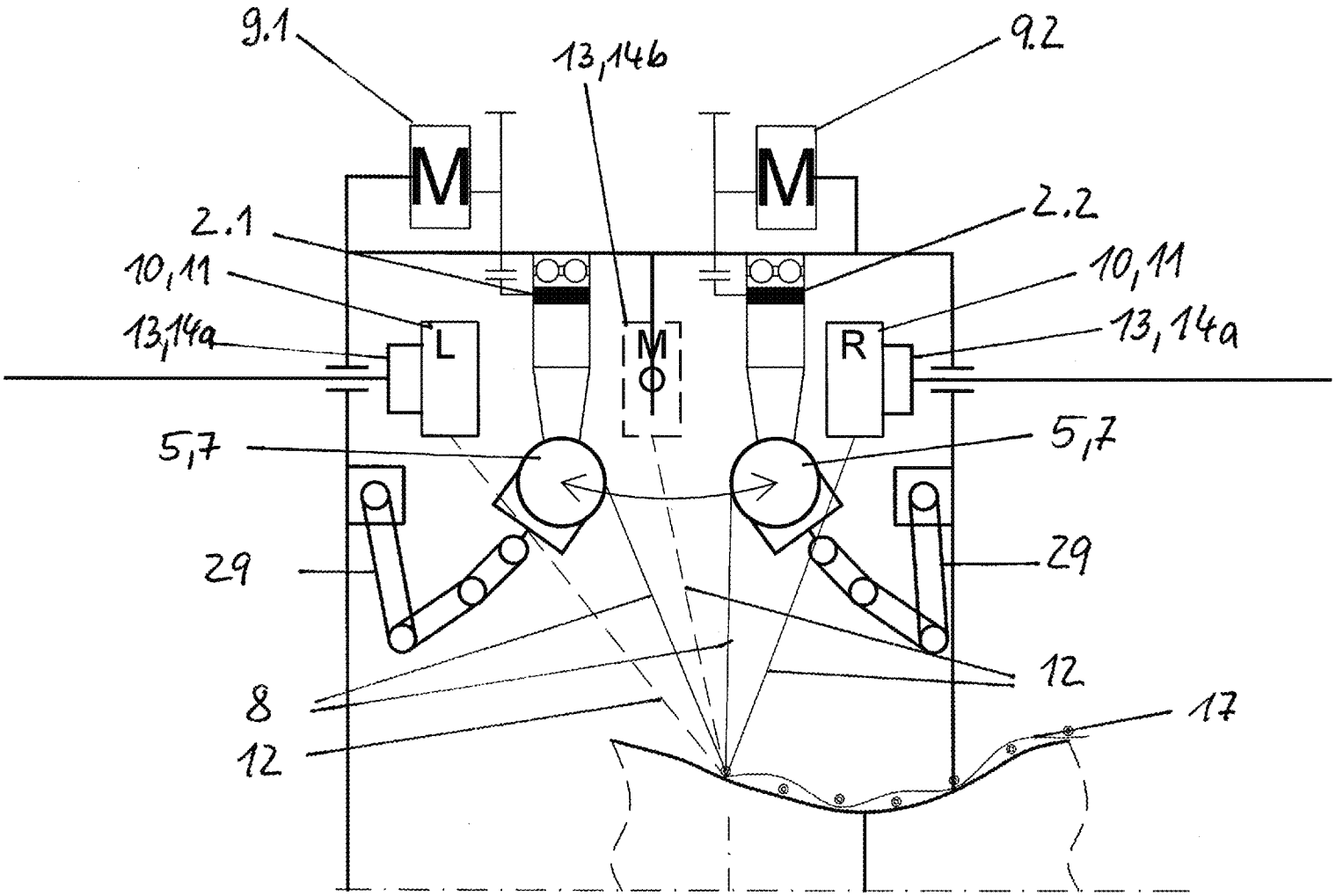
FIG. 17 A profile view of the circular weaving machine according to FIG. 8*b* with a handling robot to change the weft bobbins.

FIG. 17 shows a circular weaving machine similar to the circular weaving machine with two rotor rings 2.1, 2.2 provided for according to FIG. 8*b*, whereby in addition to the circular weaving machine according to FIG. 8*b*, handling robots 29 are provided which have gripper elements which can automatically pick up the weft bobbins 7 from the shuttle 5 at standstill and deposit them on them.

This enables, on the one hand the automated exchange of used weft bobbins 7 and, on the other, the automated change of positions between the weft bobbins 7 in operation, e.g. the weft bobbins 7 of the parallel running shuttles 5 of both rotor rings 2.1, 2.2, as illustrated by the arrow in FIG. 17. This allows a special undulation of weft yarns 8 with warp yarns 12—especially during the placement of a warp yarn bobbin 11 in the intermediate position between the two rotor rings 2.1, 2.2 (position M)—to be achieved, whereby a fabric 17 with further special weaving patterns and fabric properties can be produced.

The features listed in the illustrative embodiments described above can be combined with one another to produce further advantageous embodiments of the circular weaving machine according to the invention, which are included within the scope of the invention.

REFERENCE NUMERAL LIST

1 Weaving core, cylindrical a, irregular b
2 Circular continuous track, conveyor track, rotor, rotor ring .1, .2
3 Weaving axis
4 Machine housing
5 Shuttle
6 Weaving plane .1, .2, .3
7 Weft yarn bobbin, weft bobbin
8 Weft yarn
9 Rotor motor .1, .2
10 Warp coil device
11 Warp yarn bobbin, warp bobbin
12 Warp yarn
13 Positioning device
14 Bobbin gripper, moveable a, stationary b, gripper element
15 Guiding rods
16 Weaving angle
17 Hollow profile-like fabric
18 Shuttle holder
19 Glide or roller element
20 Slot
21 Warp bobbin ring .1, .2, .3, .4, radial inner a, radial outer b
22 Warp bobbin ring motor
23 Circular continuous track, guideway, guide track .1, .2, .3
24 Sub-track
25 Shuttle carriage
26 Guide roller
27 Shuttle motor
28 Handling robot for the positioning device
29 Weft bobbin handling robot.

What is claimed is:

1. A circular weaving machine for weaving a weaving core, wherein the weaving machine comprises (i) at least one shuttle comprising a weft yarn bobbin and being movable along a circular continuous track around the weaving core and (ii) warp coil devices each of which comprises a warp yarn bobbin, the warp coil devices being configured to be movable, with a travel path of the warp coil devices with a warp yarn bobbin extending through a weaving plane enclosed by the circular continuous track.

2. The circular weaving machine of claim 1, wherein the circular continuous track and the weaving plane enclosed by the circular continuous track are arranged quasi-radially (at an angle different from 90° in relation to the weaving axis.

3. The circular weaving machine of claim 1, wherein multiple circular continuous tracks are provided along which the at least one shuttle may be moved, the travel path of the warp coil device with the warp yarn bobbin extending through the weaving planes enclosed by the circular continuous tracks.

4. The circular weaving machine of claim 1, wherein the circular continuous track is formed by a circular guide track in or on which at least one shuttle is guided.

5. The circular weaving machine of claim 4, wherein the guide track comprises multiple sub-tracks.

6. The circular weaving machine of claim 1, wherein the shuttle(s) is/are each driven by a direct drive.

7. The circular weaving machine of claim 1, wherein the shuttle(s) is/are each driven by a rotatably mounted carrier.

8. The circular weaving machine of claim 1, wherein the circular continuous track is formed by a rotatably mounted circular rotor (conveyor track) with which the at least one shuttle may be conveyed.

9. The circular weaving machine of claim 1, wherein an axis of rotation of the weft yarn bobbin is arranged in a direction of rotation of the at least one shuttle about a weaving axis or perpendicular to the weaving axis.

10. The circular weaving machine of claim 1, wherein an axis of rotation of the warp yarn bobbin is arranged in a substantially parallel orientation to a weaving axis or in a substantially tangential orientation to the weaving axis.

11. The circular weaving machine of claim 1, wherein the travel path of the warp coil device with the warp yarn bobbin is designed in the form of a circular arc with a constant radius through the weaving plane.

12. The circular weaving machine of claim 1, wherein the warp coil device with the warp yarn bobbin is configured so that it is movable along a travel path laterally of the weaving plane.

13. The circular weaving machine of claim 1, wherein the warp coil device with the warp yarn bobbin is movable by a positioning device and can be positioned in determinable alternating positions.

14. The circular weaving machine of claim 13, wherein the positioning device comprises at least one movable bobbin gripper and one stationary bobbin gripper or at least two movable bobbin grippers.

15. The circular weaving machine of claim 13, wherein the positioning device comprises a handling robot or is arranged on a handling robot.

16. The circular weaving machine of claim 13, wherein the positioning device is arranged on a warp bobbin ring which is rotatably mounted about the weaving axis.

17. The circular weaving machine of claim 1, wherein the weft yarn bobbin can be arranged on any shuttle by a handling robot.

18. The circular weaving machine of claim 1, wherein the weaving core is configured to be axially movable and/or rotatable.

19. The circular weaving machine of claim 1, wherein the weaving core has a variable cross-sectional geometry and/or is of a multi-part design.

20. A method for producing a hollow profile-like fabric, wherein the method comprises using the circular weaving machine of claim 1 for producing the fabric.

* * * * *